US006598301B2

(12) United States Patent
McCool et al.

(10) Patent No.: US 6,598,301 B2
(45) Date of Patent: Jul. 29, 2003

(54) MULTI-PURPOSE RAZOR BLADE TOOL

(75) Inventors: Gregory F. McCool, Staunton, VA (US); Jeffrey Wonderley, Fort Defiance, VA (US); Dave McDonald, Merrimack, NH (US); Eric Litscher, Hopkinton, MA (US); John DePiano, Burlington, MA (US); Roy Heinz, Waltham, MA (US); Will Wear, Arlington, MA (US)

(73) Assignee: American Safety Razor Company, Verona, VA (US)

( * ) Notice: Subject to any disclaimer, the term of this patent is extended or adjusted under 35 U.S.C. 154(b) by 0 days.

(21) Appl. No.: 09/867,765

(22) Filed: May 31, 2001

(65) Prior Publication Data

US 2002/0007558 A1 Jan. 24, 2002

Related U.S. Application Data

(60) Provisional application No. 60/208,492, filed on Jun. 2, 2000, and provisional application No. 60/278,661, filed on Mar. 27, 2001.

(51) Int. Cl.[7] ..... B26B 1/06

(52) U.S. Cl. ..... 30/321; 30/125; 30/169; 30/2

(58) Field of Search ..... 30/321, 125, 531, 30/541, 169, 2; 15/236.01

(56) References Cited

U.S. PATENT DOCUMENTS

| | | | | | |
|---|---|---|---|---|---|
| 2,133,087 | A | * | 10/1938 | Ericsson | 30/321 |
| 2,164,050 | A | * | 6/1939 | Brown | 30/321 |
| 2,710,447 | A | * | 6/1955 | Borden | 30/321 |
| 3,518,758 | A | * | 7/1970 | Bennett | 30/321 |
| 4,026,017 | A | | 5/1977 | Arnold | |
| 5,251,379 | A | | 10/1993 | Kuo | |
| 5,787,594 | A | * | 8/1998 | Estrada | 30/531 |

FOREIGN PATENT DOCUMENTS

GB 2245859 A 1/1992

* cited by examiner

*Primary Examiner*—Douglas D. Watts
(74) *Attorney, Agent, or Firm*—McDermott, Will & Emery

(57) ABSTRACT

A razor blade tool relating to overcoming single use shortcomings of current utility knives allows a user to select multiple razor blade positions. Each razor blade position allows a razor blade tool to be utilized for a different purpose, such as scraping, case cutting, twine cutting, and as a knife. Additional razor blades are stored in a razor blade tool in a manner that prevents the sharpened edges of razor blades from contacting side-walls of the storage area so that stored razor blades remain sharp and undamaged.

18 Claims, 29 Drawing Sheets

MULTI-PURPOSE RAZOR BLADE TOOL

RELATED APPLICATIONS

This application claims the benefit of U.S. Provisional Patent Application Serial No. 60/208,492 entitled MULTI-PURPOSE CUTTING TOOL invented by Dave McDonald et al. filed, Jun. 2, 2000, which is incorporated herein by reference. This application also claims the benefit of U.S. Provisional Patent Application Serial No. 60/278,661 invented by Gregory F. McCool et al. filed Mar. 27, 2001, which is incorporated herein by reference.

FIELD OF THE INVENTION

The present invention relates to razor blade tools, and in particular to razor blade tools having multiple razor blade positions.

BACKGROUND ART

Typically, utility knives are designed for a single purpose, making them specialized tools. For example, a box knife is commonly designed to expose a small portion of a standard razor blade in order to cut open containers without cutting the contents of the container. A scraper is designed to expose the entire sharp edge of a standard razor blade in a fashion that allows the razor blade edge to be placed flat-wise against a surface, such as a painted wall or a car windshield, in order to scrape a substance off of the surface, e.g., paint or a sticker adhered to the surface. Thus, one may find in a tool box, or a utility drawer at home, multiple utility knives, each of which is used for a single specialized purpose. There are no current utility knives that allow a user of the utility knife to position a razor blade in a plurality of positions, each position permitting the utility knife to perform a different specialized task.

In addition to specialized designs for utility knives, changing a razor blade in current utility knives is often a cumbersome and hazardous task. Several steps are often needed, such as removing a screw, prying apart a housing, disengaging a razor blade from the tool, engaging a new razor blade into the tool, reassembling the housing, and fastening the housing together using a screw or other fastening device, in order to change a razor blade from a single tool. Many utility knives also expose the user to an unacceptably high risk of being cut due to razor blade exposure and/or difficulty with removing a razor blade from the utility knife while changing the razor blade.

There exists a need for a razor blade tool that enables a user to use one tool for a multitude of specialized tasks that currently require several utility knives. There exists a particular need for a razor blade tool having a razor blade that is easily changed, and that does not expose a user to a high risk of injury while changing the razor blade.

SUMMARY OF THE INVENTION

These and other needs are met by embodiments of the present invention, which provide a razor blade tool capable of performing a variety of specialized tasks. Razor blade tools constructed according to the present invention comprise a handle portion and a razor blade housing, where the razor blade housing holds a razor blade in a plurality of positions, each position exposing a sharp edge of the razor blade in a different manner outside of the razor blade housing.

In certain embodiments of the present invention, a razor blade device comprises a handle portion, a razor blade retaining portion, and a razor blade storage area. The razor blade storage area stores razor blades so that sharp edges of the razor blades do not contact side-walls of the razor blade storage area. The razor blade storage area comprises an upper surface, which comprises a moveable cover that provides access to the storage area, a lower surface, side-wall surfaces, and a post attached to the lower surface. The post is at least as high as the side-walls, and is configured to pass through a center aperture in stored razor blades. The post also engages the cover when the cover is in a closed position.

In certain other embodiments of the present invention, a razor blade device comprises a handle portion, a razor blade housing, and a razor blade carrier within the razor blade housing. The razor blade carrier retains a razor blade, and is rotatable within the razor blade housing. The razor blade device also comprises a rotation mechanism that is non-rotatably connected to the razor blade carrier, is rotatably connected to the razor blade housing, and is accessible outside of the razor blade housing. When in a first position, the rotating mechanism engages the razor blade housing to prevent rotation of the razor blade carrier. When in a second position, the rotating mechanism disengages the razor blade housing to allow rotation of the razor blade carrier.

Additional advantages and other features of the present invention will be set forth in part in the description that follows, and in part will become apparent to those having ordinary skill in the art upon examination of the following, or maybe learned by practice of the invention.

DETAILED DESCRIPTION OF THE INVENTION

The present invention addresses and solves problems related to specialized utility knives that have only one, or a few uses. The present invention also addresses and solves problems related to quick, easy, and safe changing of a razor blade into and out of a razor blade tool. The present invention addresses and solves such problems by providing a razor blade tool that rotatably holds a razor blade. A razor blade is rotated within the razor blade tool to various positions according to the function that the user of the razor blade tool wishes to perform. For example, in one position, a razor blade is positioned to act as a scraper. In another position, a razor blade is positioned to act as a box knife. In another position, a razor blade is positioned in a twine cutting position. In yet another position, a razor blade may be used as a knife. In certain embodiments, when the razor blade carrier within the razor blade tool is positioned so that the razor blade acts as a scraper, the razor blade may be easily removed from and inserted into the razor blade tool without requiring additional tools, and without unduly exposing the user to the risk of being cut.

Figure 1:
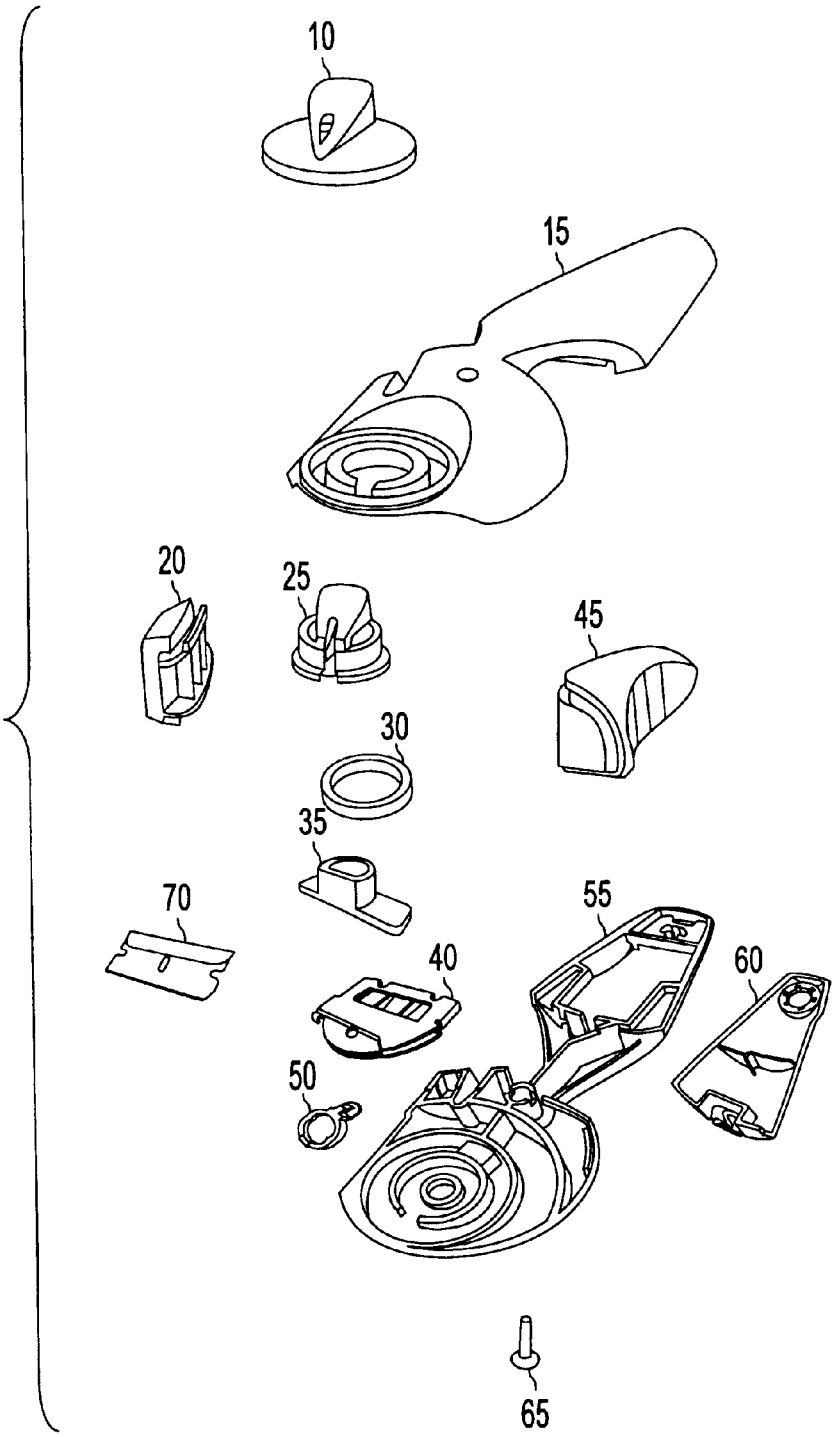
FIG. 1 depicts a top exploded assembly view according to an embodiment of the present invention.
Figure 2:
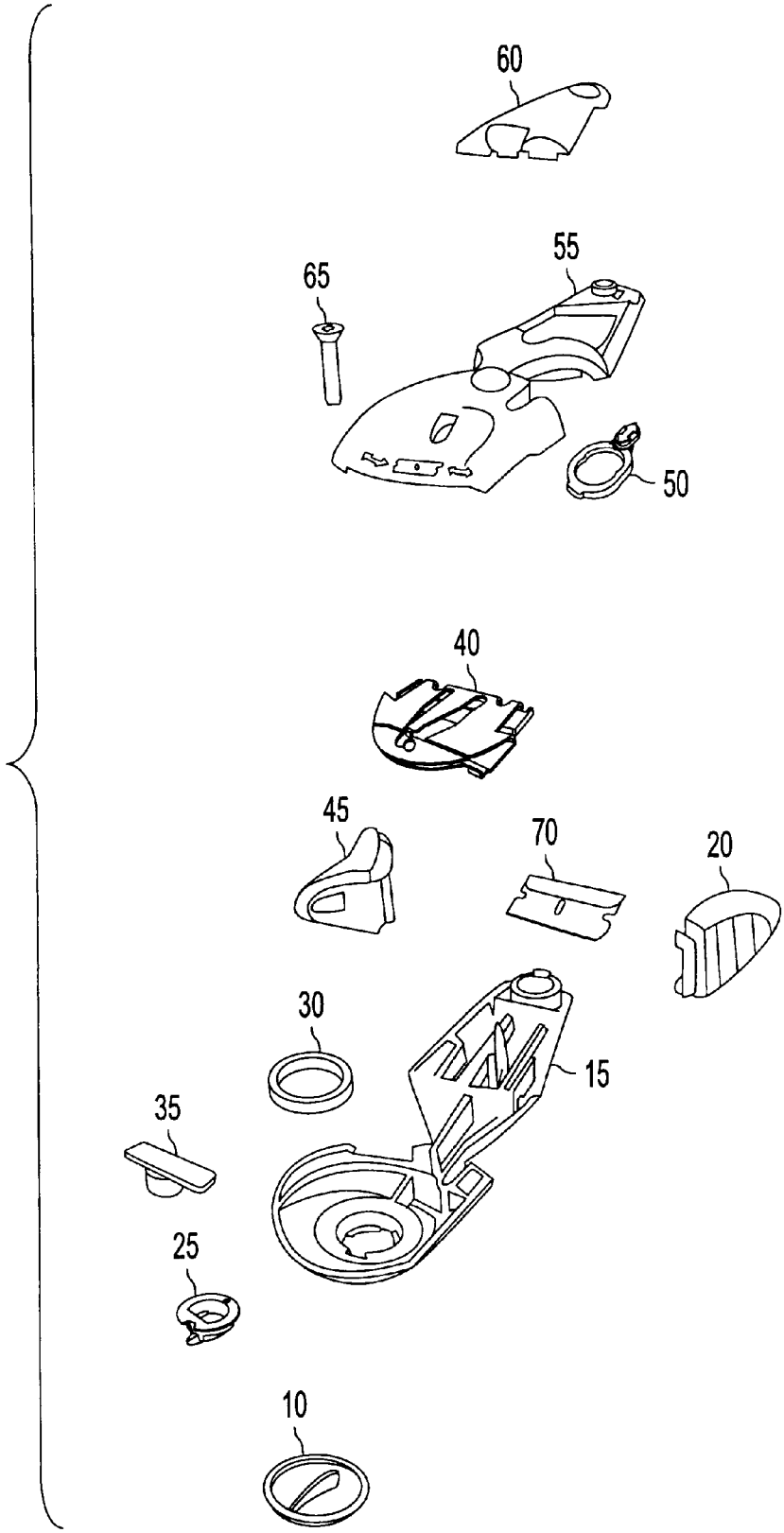
FIG. 2 depicts a bottom exploded assembly view according to the embodiment of the present invention depicted in FIG. 1.
Figure 2A:
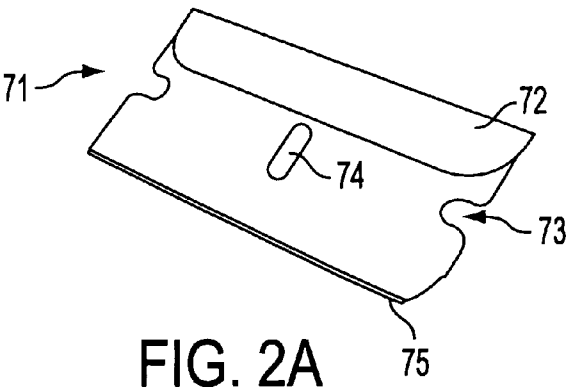
FIG. 2*a* depicts an embodiment of a razor blade carrier according to the embodiment of the present invention depicted in FIG. 1.

Adverting to FIGS. 1 and 2, the components of a razor blade tool according to an embodiment of the present invention are described. Although only one embodiment of the present invention is depicted and described, one of ordinary skill in the art will recognize the various embodiments that the present invention encompasses. Describing the depicted embodiment of the present invention, a top housing 15, and a bottom housing 55 are utilized to form a handle portion and a razor blade housing for a razor blade tool. The top housing 15 and the bottom housing 55 also cooperate to retain the various components of the razor blade tool, as well as replacement razor blades. The bottom housing 55 retains a lock member 50, which slidably engages the bottom housing 55. A cover 60 is movably attached to bottom housing 55. In certain embodiments, cover 60 is rotatably attached to bottom housing 55.

Figure 2C:
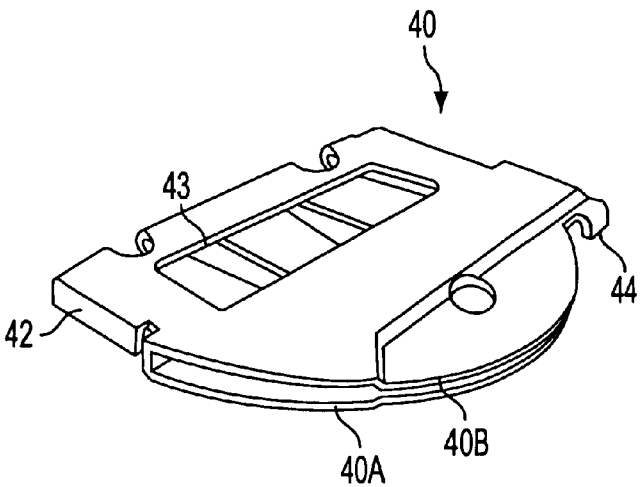
FIG. 2*c* depicts a top view of the razor blade carrier according to the embodiment of the present invention depicted in FIG. 1.

Razor blade carrier 40 rotatably resides between bottom housing 55 and top housing 15. Key 35 is non-rotatably retained on razor blade carrier 40. For example, the bottom portion of key 35 fits within recess 43 on the razor blade carrier 40 (FIG. 2*c*). Additionally, spring 30 is placed onto key 35 and is compressed when the razor blade tool is assembled. Compression of spring 30 assists in retaining key 35 within the recess 43 of razor blade carrier 40. Spring 30 is, for example, a wave spring, or an elastomeric spring. For example, a wave spring is formed from a sheet of metal by stamping, and comprises undulating top and bottom surfaces so that when the spring 30 is compressed, it exerts force against the compressive force. An elastomeric spring is made of rubber, for example, or other elastomeric material that exerts an opposing force to a compressive force applied upon the spring 30.

When the razor blade tool is assembled, insert knob 25 is placed over the top of spring 30, and non-rotatably engages key 35. Insert knob 25 comprises a protrusion 26 that is utilized to retain razor blade 70 or 71 in a user selected position by locking the razor blade carrier 40 in a user selected position. Insert knob 25, spring 30, key 35, razor blade carrier 40 and lock 50 are all retained between top housing 15 and lower housing 55 by compressive forces exerted by an attaching element 65, for example, a screw or a rivet. The previously recited elements comprise the rotating mechanism in the exemplary embodiment of the invention. A portion of lock 50 protrudes outside of lower housing 55 to allow a user to move lock 50 between an unlocked position and a locked position. Grips 20, and 45 may, for example, also be attached to housing portions 15 and 55 by compressive forces exerted by attaching element 65. Knob 10 is designed to non-rotatably engage insert knob 25 so that rotation of knob 10 causes insert knob 25 to rotate. Because insert knob 25 non-rotatably engages key 35, and key 35 non-rotatably engages razor blade carrier 40, rotation of knob 10 causes the insert knob 25, the key 35, and the razor blade carrier 40 to rotate. Rotation of knob 10 is accomplished by pushing down on knob 10 in order to overcome the force exerted by spring 30. As described infra, pushing down on knob 10 is required to disengage positioning element 26 from slot 16, which allows razor blade carrier 40 to rotate on track 57. Rotation of the razor blade carrier 40 is free from obstruction once knob 10 has been pushed enough to overcome the force exerted by spring 30.

Top housing 15, bottom housing 55, grip 20, and grip 45 are designed to give the razor blade tool 5 of the present invention an ergonomic design. For example, housing portions 15 and 55 are tapered to easily fit within the palm of a user's hand and fit the contours of the user's hand. Grip 20 is, for example, a finger grip designed to match the contours of a user's finger pad. Grip 45 is, for example, a thumb grip designed to match the contours of a user's thumb pad. Grips 20 and 45 are made from a material with a high co-efficient of friction, for example, a non-slip elastomer, or plastic with a rough surface. Such ergonomic design and non-slip materials co-operate to automatically position a user's hand safely away from the exposed, sharp edge of the razor blade, and to prevent the user's hand from slipping off of the razor blade tool 5 towards the sharp edge of the razor blade 70, 71.

Figure 6:
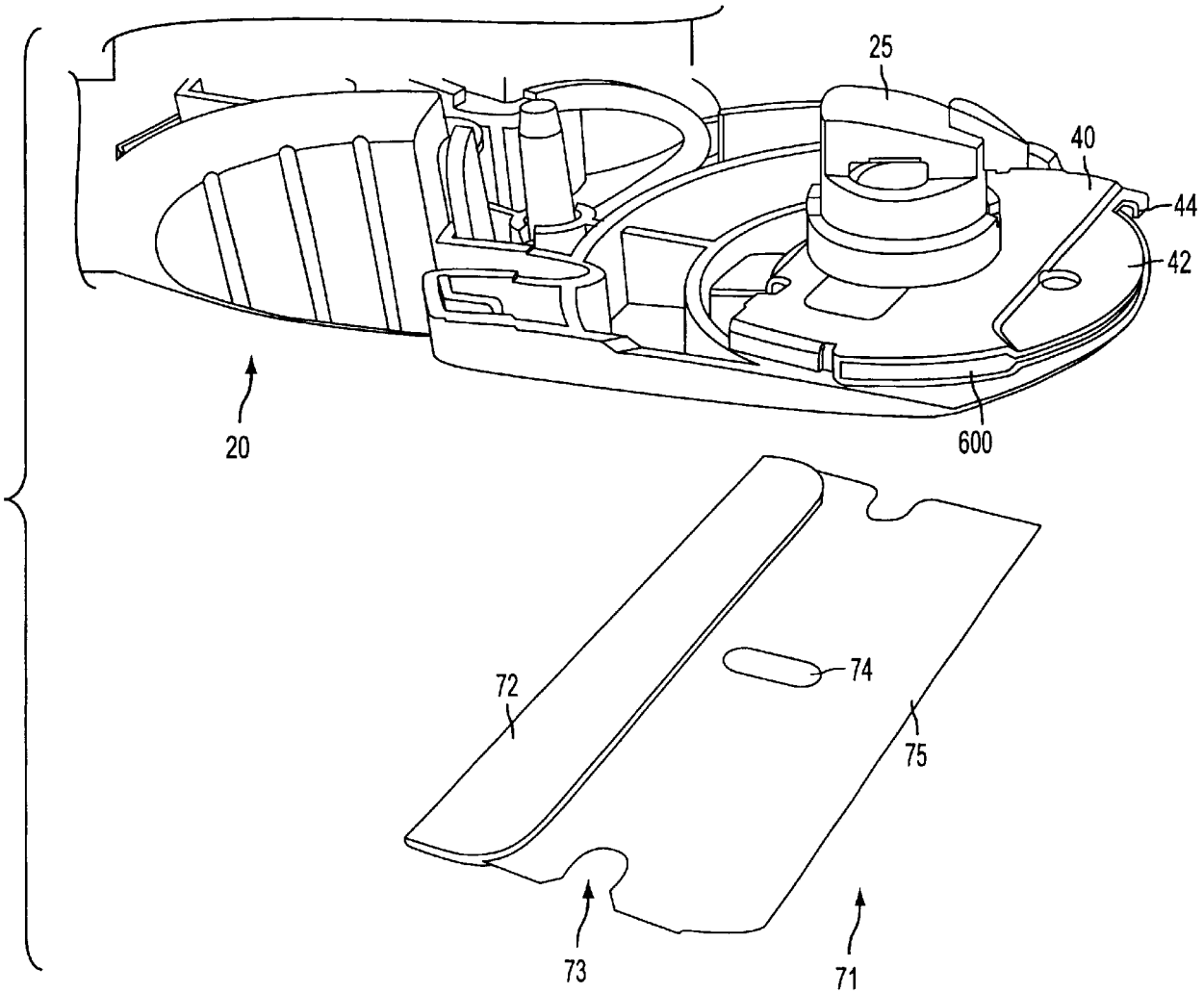
FIG. 6 depicts a cut-away view of a razor blade tool prior to insertion of a razor blade according to the embodiment of the invention depicted in FIG. 1.
Figure 18:
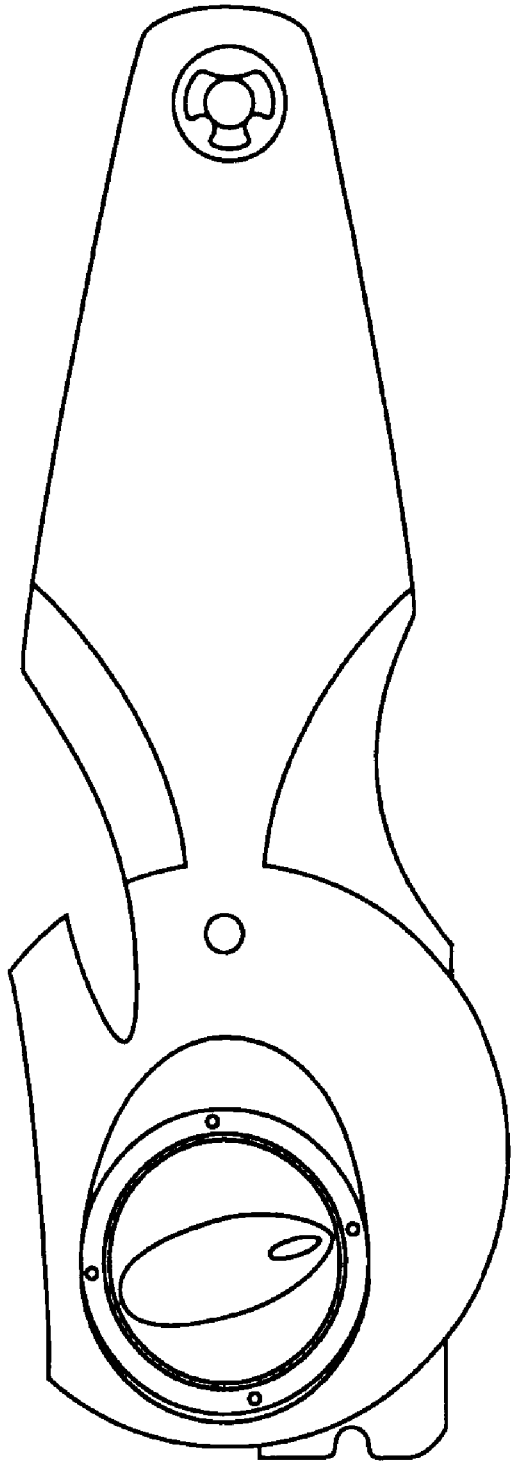
FIG. 18 depicts a top view of a razor blade tool showing the razor blade in the position depicted in FIG. 12.
Figure 19:
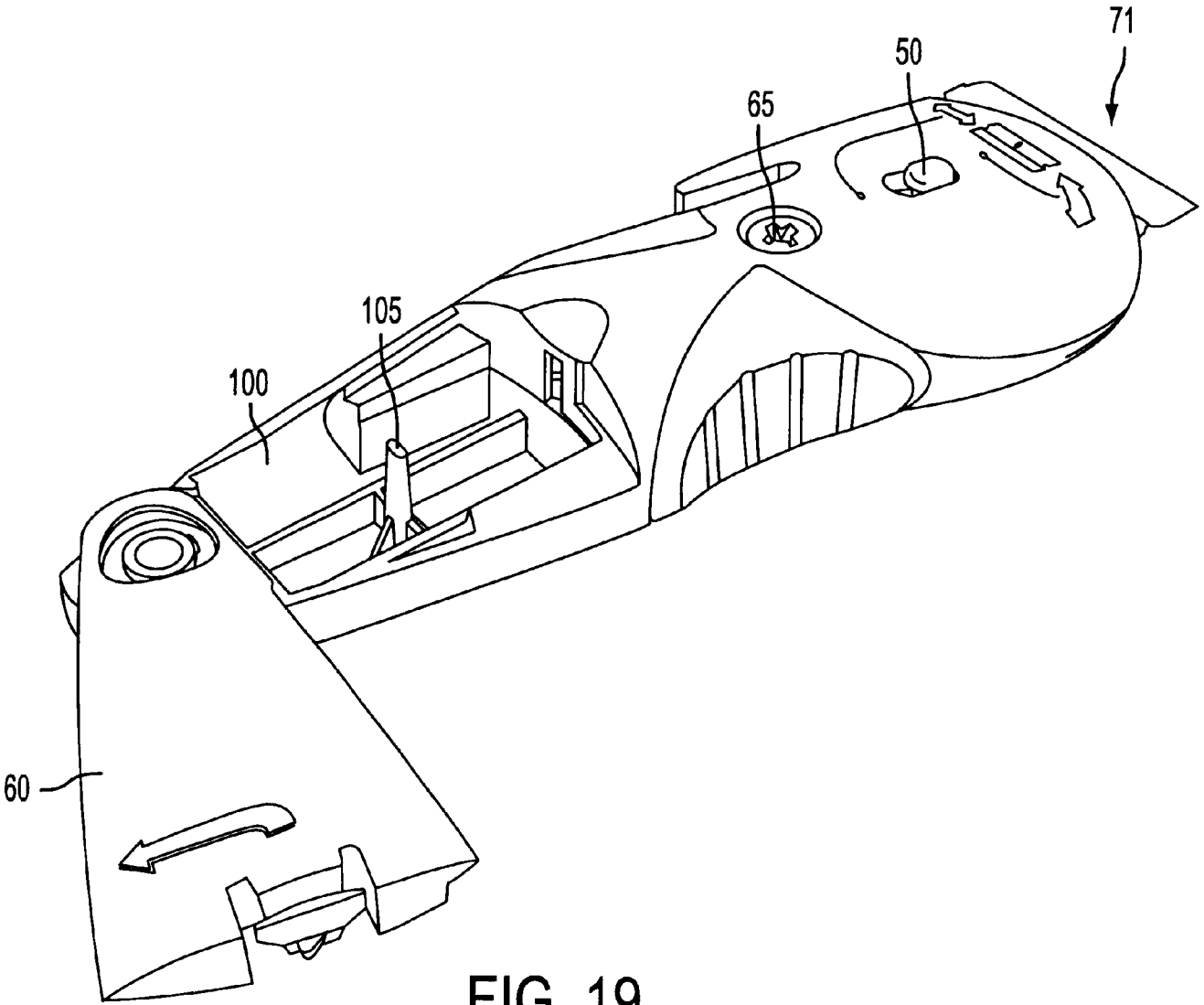
FIG. 19 depicts a bottom view of a razor blade tool showing a cover in an open position to expose a razor blade storage area according to the embodiment of the present invention depicted in FIG. 1.

Referring to FIG. 6, placing a razor blade 71 into an embodiment of a razor blade tool according to the present invention is described. Note that razor blade 71 differs from razor blade 70 in that the right-hand corner portion of the sharp edge is rounded and not square. Such rounding of the sharp edge of the razor blade 71 allows the razor blade to protrude a lesser distance when in the case cutting position (FIG. 18) so that the contents of the box are not cut when the box is opened.

Figure 7:
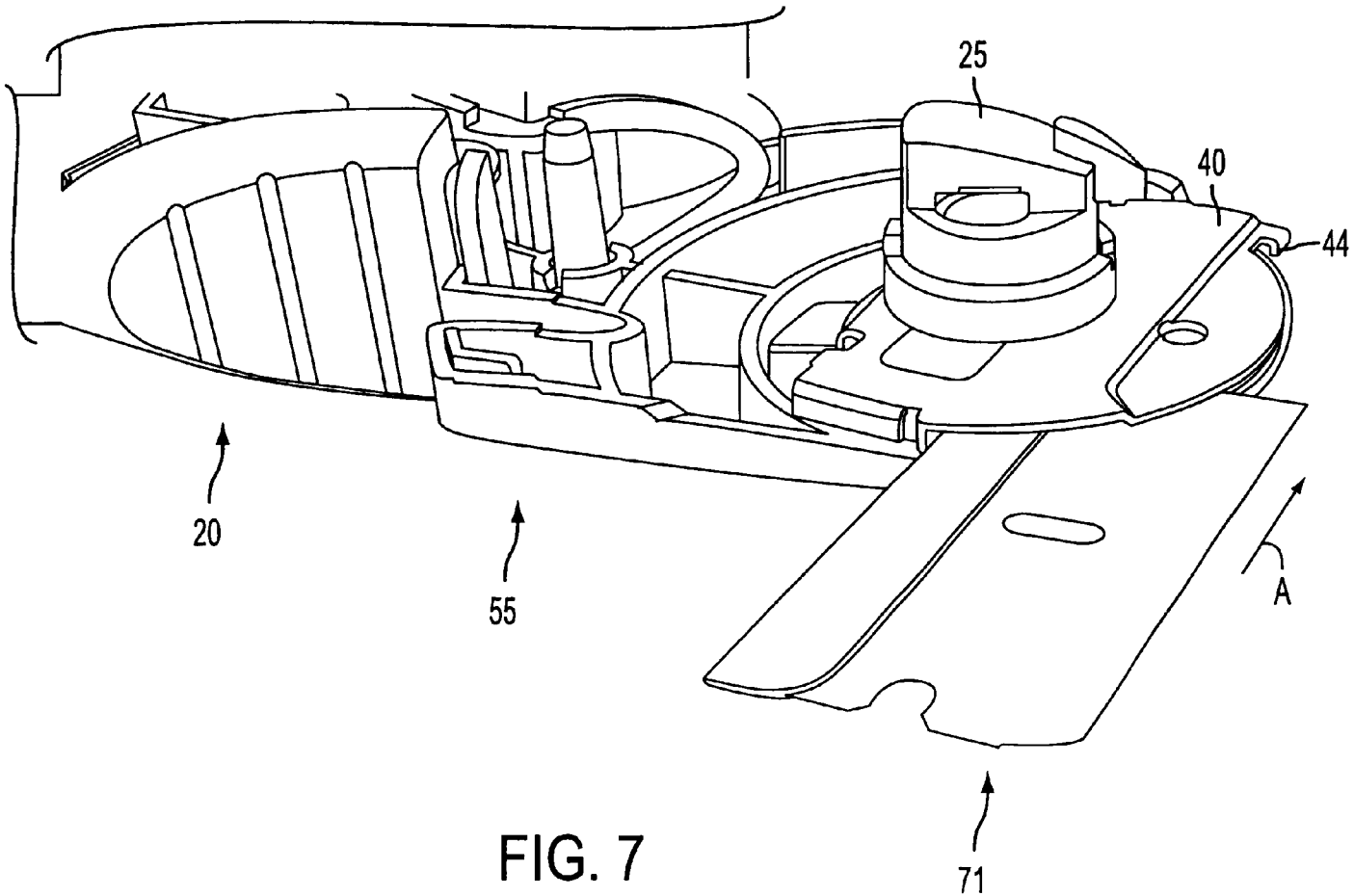
FIG. 7 depicts a cut-away view of a razor blade tool with a razor blade partly inserted into the razor blade tool according to the embodiment of the present invention depicted in FIG. 1.
Figure 8:
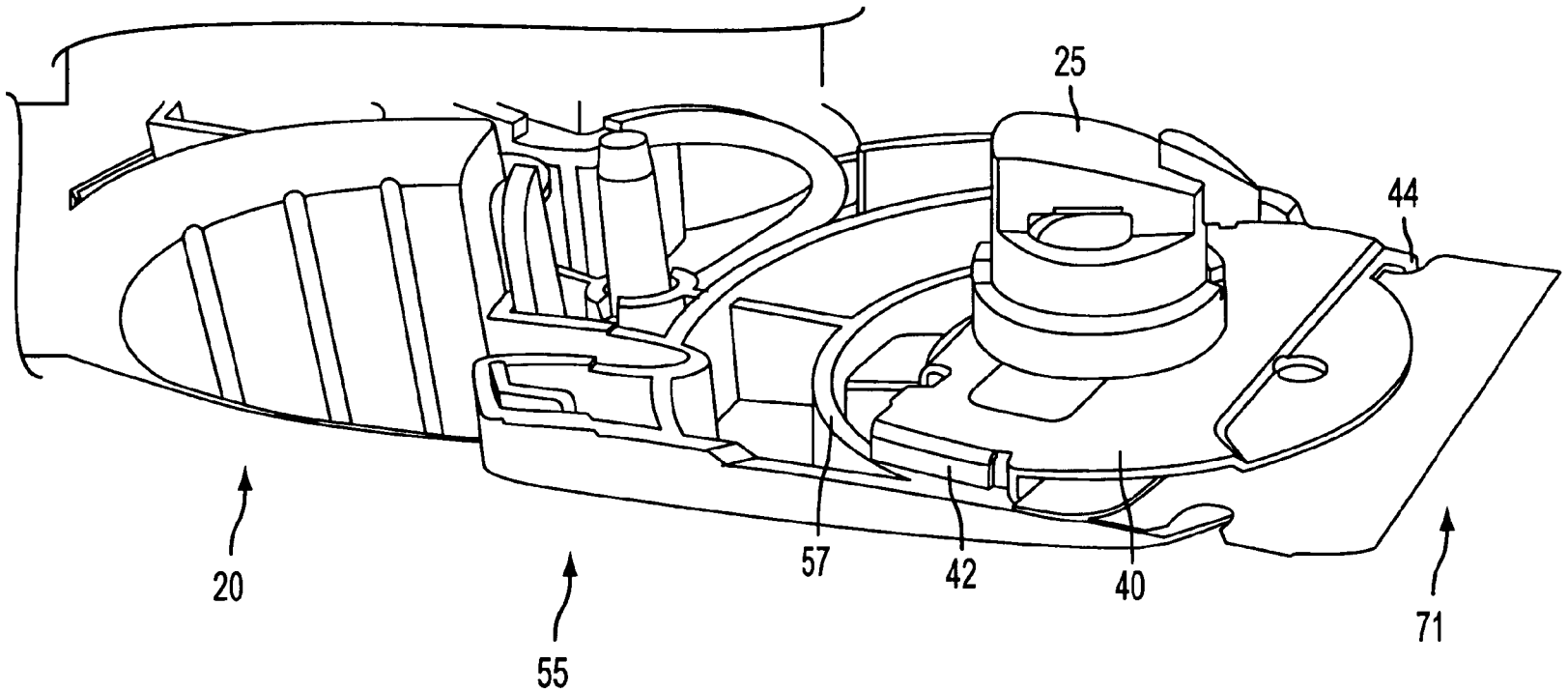
FIG. 8 depicts a cut-away view of a razor blade tool with a razor blade fully inserted into the razor blade tool according to the embodiment of the present invention depicted in FIG. 1.
Figure 17:
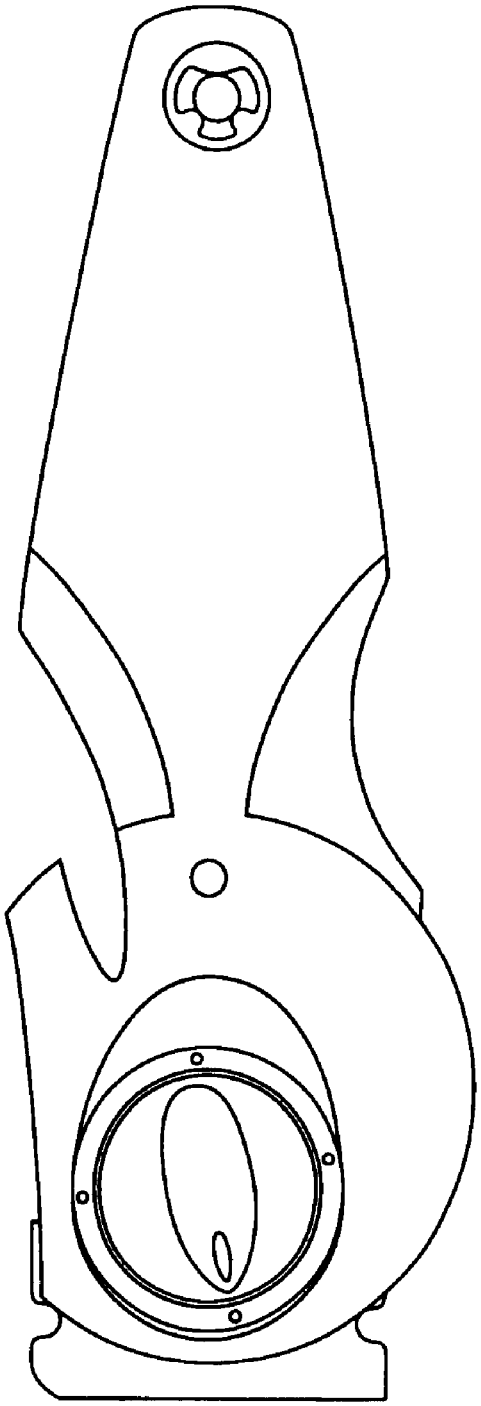
FIG. 17 depicts a top view of a razor blade tool showing the razor blade in the position depicted in FIG. 11.

Knob 10 is turned so that the razor blade carrier 40 is in the scraper position, as depicted in FIG. 17. Although shown removed, note that the razor blade 71 is inserted into the razor blade tool 5 with the top housing portion 15 in place. FIGS. 6, 7, and 8 depict placing a razor blade into the razor blade tool 5 with the top housing 15 removed for clarity only.

Figure 2B:
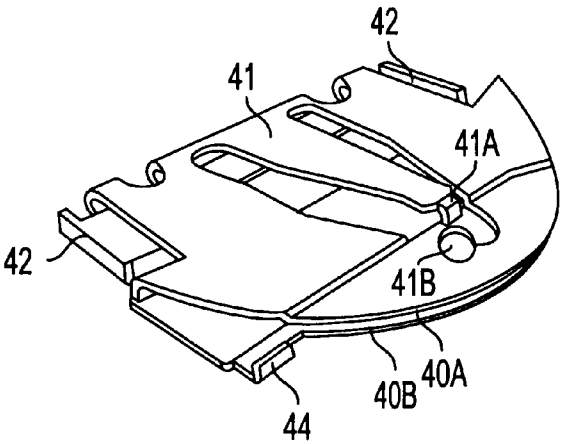
FIG. 2*b* depicts a bottom view of a razor blade carrier according to the embodiment of the present invention depicted in FIG. 1.

In the exemplary embodiment of the present invention, razor blade carrier 40 is formed from sheet metal and is folded numerous times to achieve the shape depicted in FIGS. 2*b* and 2*c*. Razor blade carrier 40 has a top element 40*a* and a bottom element 40*b*. Razor blade carrier 40 is folded in a manner that allows top element 40*a* to lie on top of bottom element 40*b* so that razor blade 71 is allowed to slide in between element 40*a* and 40*b*.

As shown in FIG. 6, razor blade carrier 40 is open along the front edge where the razor blade 71 is inserted. The backing portion 72 of razor blade 71 is placed within opening 600 formed in razor blade carrier 40. Opening 600 is formed when the metal sheet comprising razor blade carrier 40 is stamped and/or folded to create razor blade carrier 40. As depicted in FIG. 6, opening 600 has a mouth area which is wider than the width of backing area 72 on razor blade 71. Inserting the razor blade 71 into razor blade carrier 40 is facilitated by forming the mouth of opening 600 to be wider than the width of backing 72 on the razor blade 71. The wide mouth of opening 600 gives the user of razor blade tool 5 a large target area into which to insert backing 72 of razor blade 71. The angled portion of opening 600 guides the backing 72 into proper alignment with respect to razor blade carrier 40, as depicted in FIG. 7.

The razor blade body 75 of razor blade 71 slides between elements 40*a* and 40*b* of razor blade carrier 40 as the user inserts the razor blade 71 into the razor blade tool 5. The user continues to push razor blade 71 in the direction of arrow A until notch 73, formed in the razor blade 71, engages tab 44 formed on razor blade carrier 40. Engagement of tab 44 with notch 73 indicates that razor blade 71 is in the proper position on the razor blade carrier 40, and also acts as a securing point to prevent rotation of razor blade 71 with respect to razor blade carrier 40. Once the razor blade 71 has been inserted into razor blade carrier 40, as depicted in FIG. 8, the user locks the razor blade 71 into the razor blade carrier 40 as described infra.

Referring now to FIGS. 9*a*–9*d*, and to FIG. 2*b*, locking the razor blade 71 into the razor blade carrier 40 is explained. Referring to FIG. 2*b*, engagement element 41 is designed with engaging tab 41*a* which passes through aperture 41*b* in the razor blade carrier 40. Referring again to FIG. 9*a*, cam surface 56 is utilized to apply pressure to engagement element 41 in order to force engaging tab 41*a* through aperture 41*b*. Lock 50 is slidably retained within cam surface 56, and has a tab 51 that fits into notch 58 of cam surface 56.

Figure 2D:
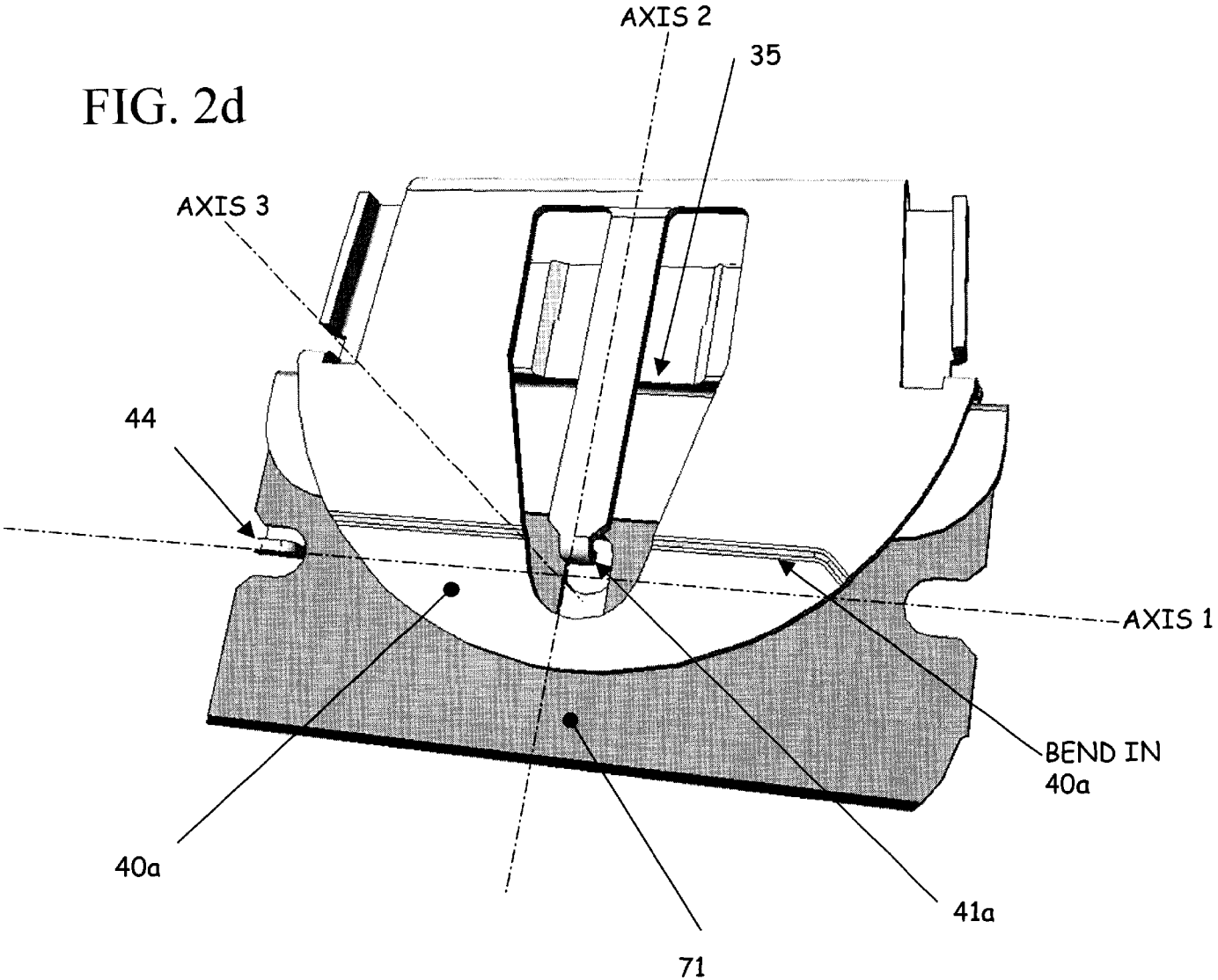
FIG. 2*d* depicts a top view of the razor blade carrier retaining a razor blade according to the embodiment of the present invention depicted in FIG. 1.
Figure 3B:
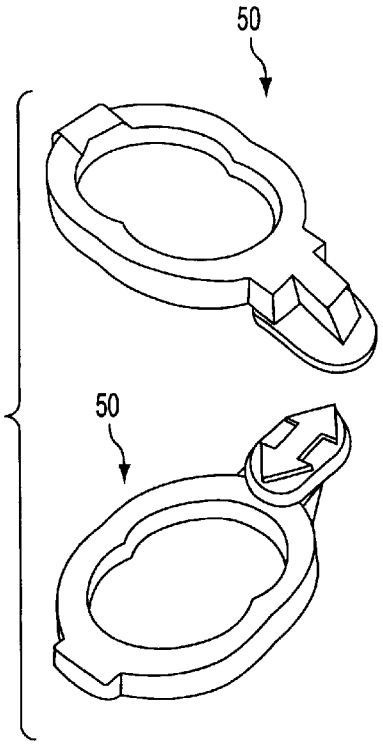
FIG. 3*b* depicts a top view and a bottom view of a lock component according to the embodiment of the present invention depicted in FIG. 1.
Figure 3C:
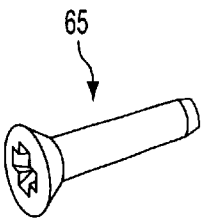
FIG. 3*c* depicts a screw used to attach the top housing and the bottom housing according to the embodiment of the present invention depicted in FIG. 1.
Figure 3A:
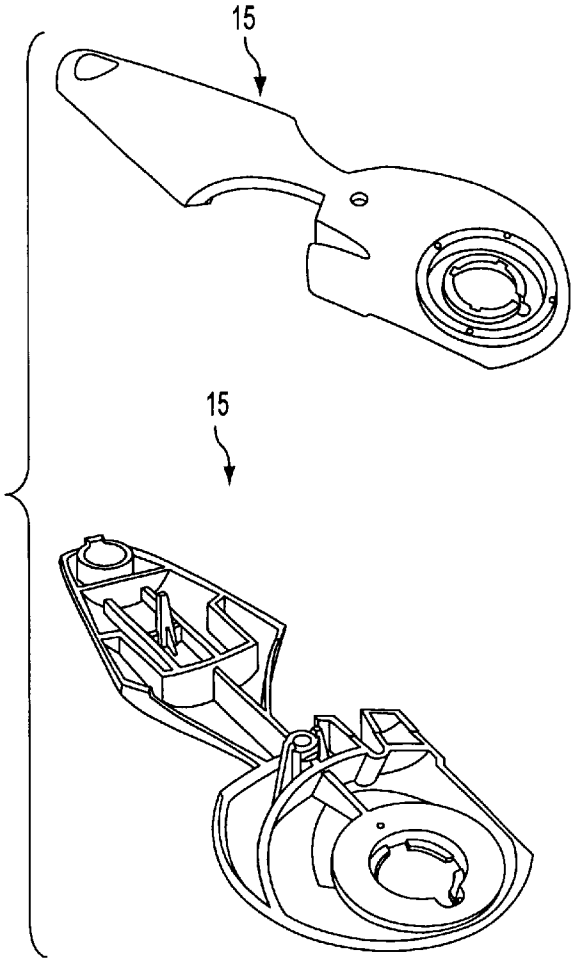
FIG. 3*a* depicts a top view and a bottom view of a top housing portion according to the embodiment of the present invention depicted in FIG. 1.
Figure 3D:
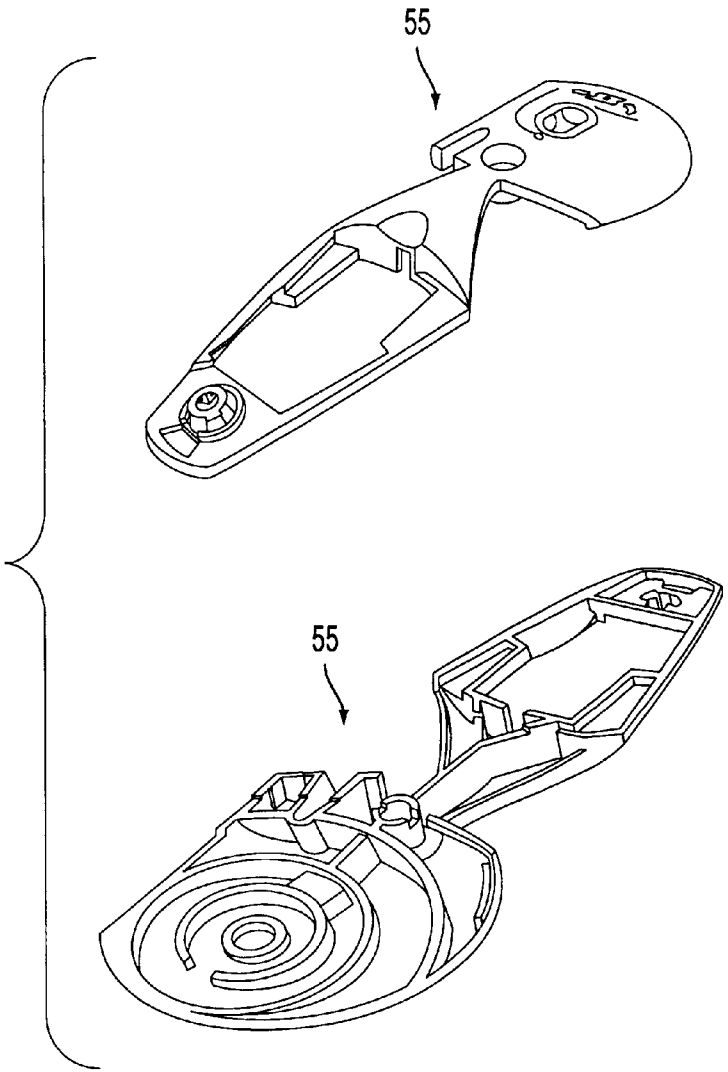
FIG. 3*d* depicts a top view and a bottom view of the bottom housing according to the embodiment of the present invention depicted in FIG. 1.
Figure 4B:
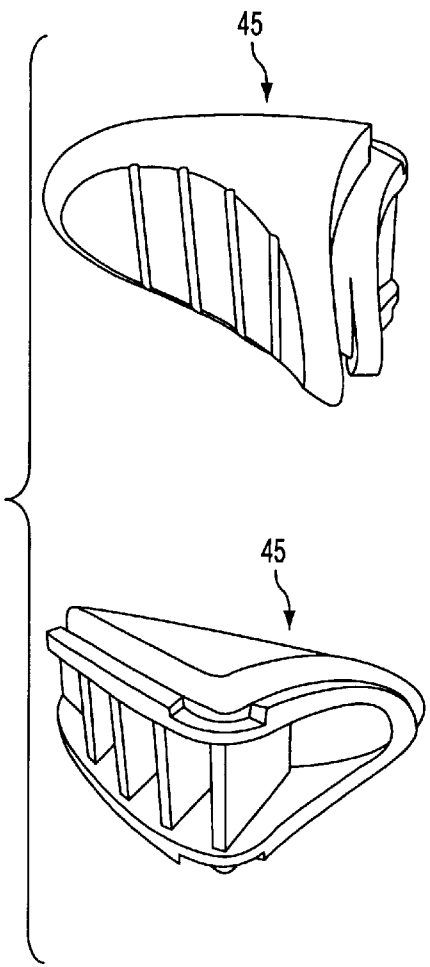
FIG. 4*b* depicts a top view and a bottom view of a second grip portion according to the embodiment of the present invention depicted in FIG. 1.
Figure 4A:
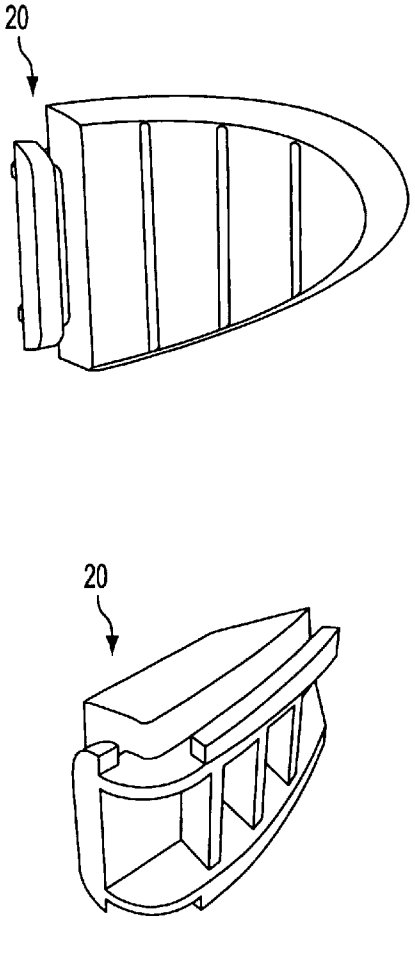
FIG. 4*a* depicts a top view and a bottom view of a first grip portion according to the embodiment of the present invention depicted in FIG. 1.
Figure 4C:
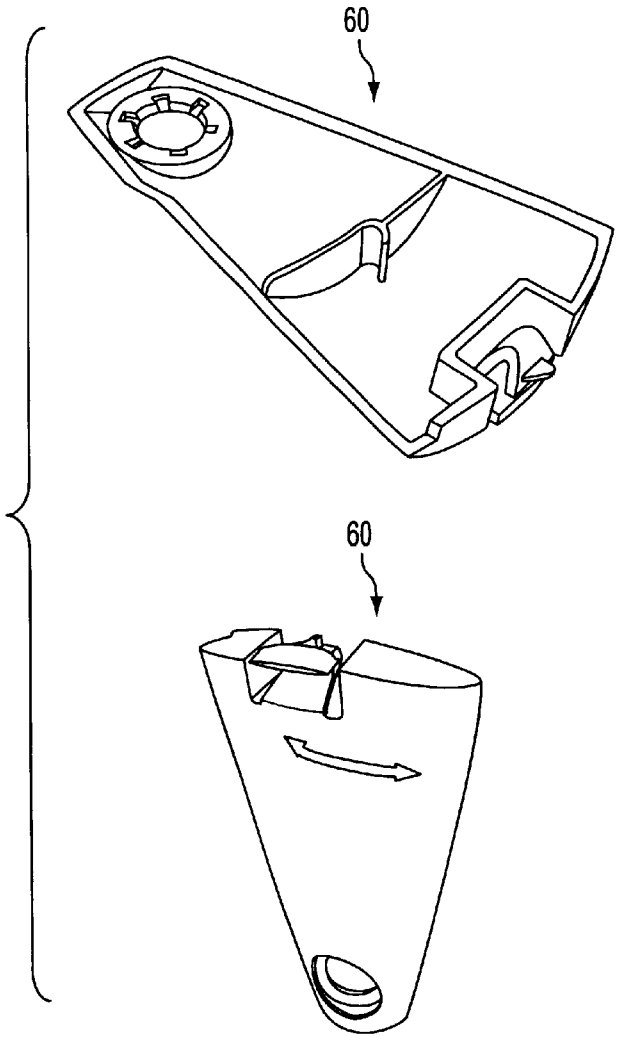
FIG. 4*c* depicts a top view and a bottom view of a cover according to the embodiment of the present invention depicted in FIG. 1.
Figure 5B:
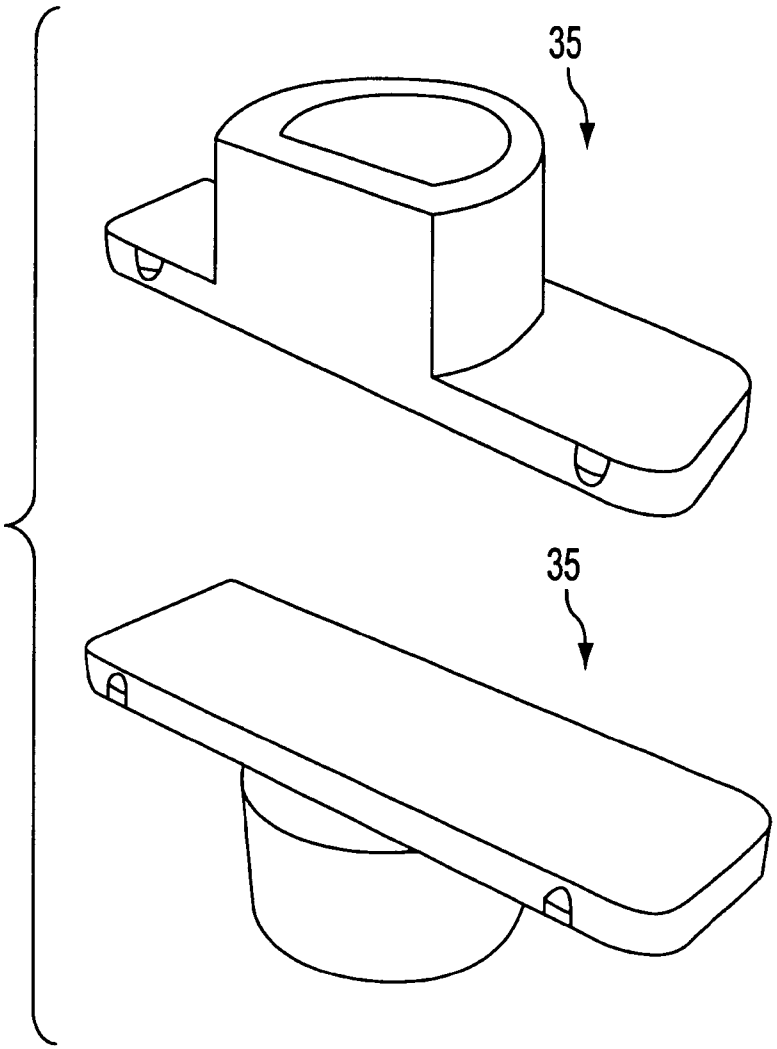
FIG. 5*b* depicts a top view and a bottom view of a key according to the embodiment of the present invention depicted in FIG. 1.
Figure 5A:
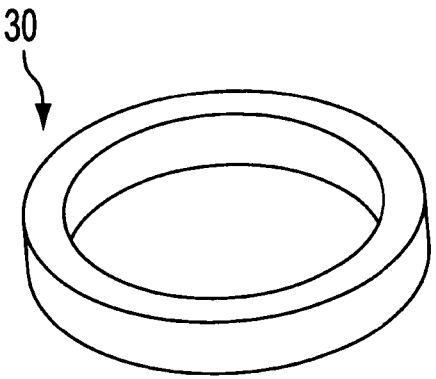
FIG. 5*a* depicts an enlarged boundary representation of a spring according to the embodiment of the present invention depicted in FIG. 1.
Figure 5D:
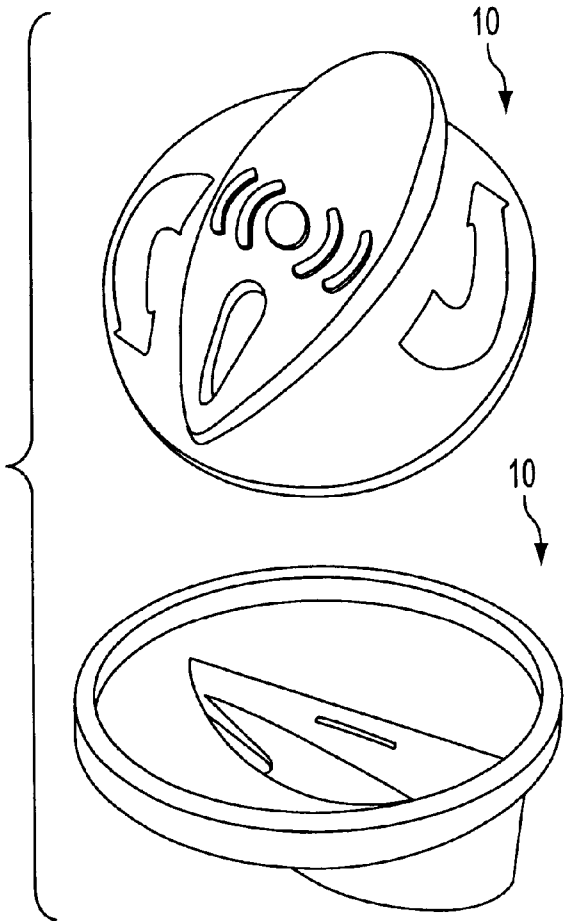
FIG. 5*d* depicts a top view and a bottom view of a knob according to the embodiment of the present invention depicted in FIG. 1.
Figure 5C:
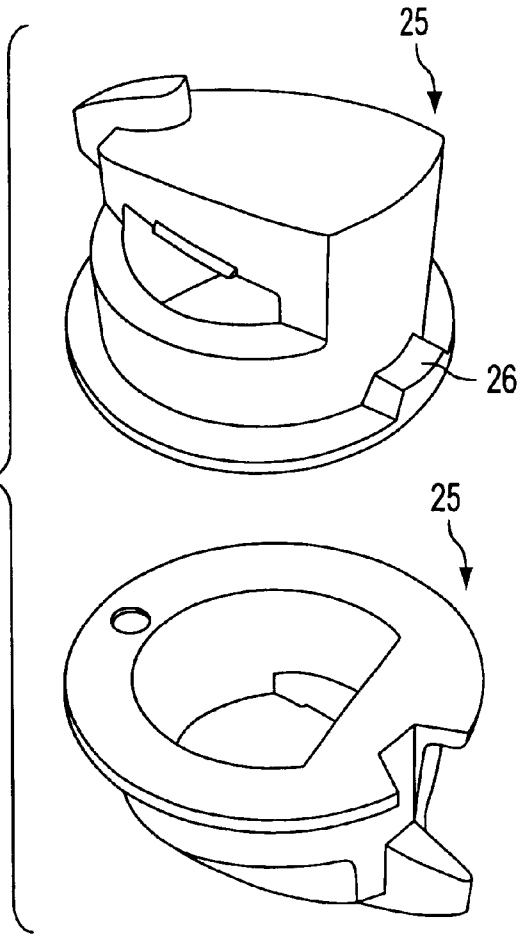
FIG. 5*c* depicts a top view and a bottom view of a knob insert according to the embodiment of the present invention depicted in FIG. 1.
Figure 9A:
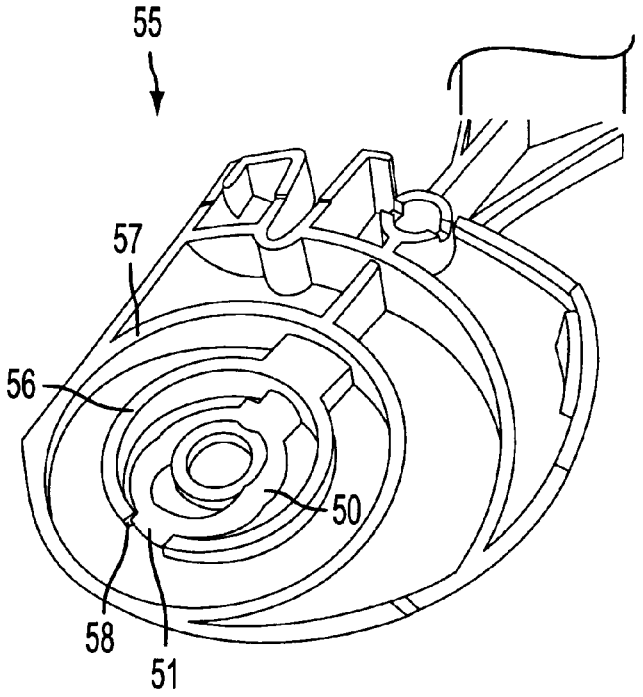
FIG. 9*a* depicts a cut-away view of a razor blade tool showing a lock in a locked position.
Figure 9B:
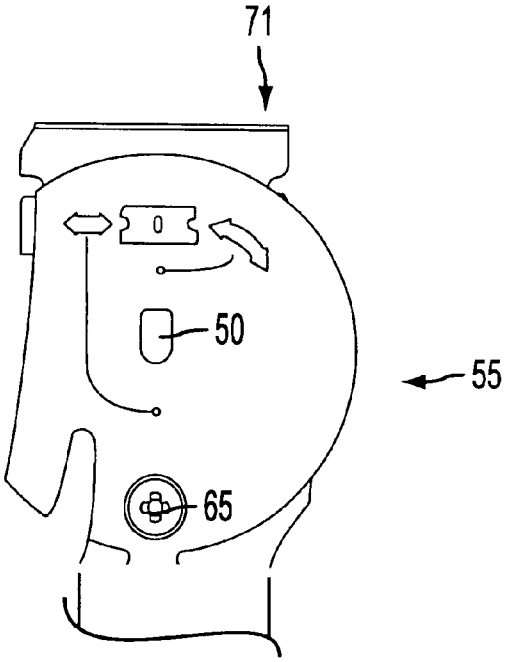
FIG. 9*b* depicts a bottom view of a razor blade tool with a lock in a locked position according to the embodiment of the present invention depicted in FIG. 1.

When the lock 50 is pushed to the forward position, i.e., locked position, as depicted in FIGS. 9*a* and 9*b*, tab 51 engages notch 58 and is of sufficient height to comprise a portion of cam surface 56. By filling notch 58, and becoming a portion of cam surface 56, tab 51 acts to force engagement element 41 towards razor blade carrier 40, thus forcing engaging tab 41*a* through aperture 41*b* in the razor blade carrier 40. Forcing engaging tab 41*a* through aperture 41*b* allows tab 41*a* to pass through center hole 74 of razor blade 71, and thus retain razor blade 71 within razor blade carrier 40. When engaging tab 41*a* has been forced through aperture 41*b*, and center hole 74, engaging tab 41*a* acts in conjunction with tab 44 to retain razor blade 71 within razor blade carrier 40. Tab 44, engaging tab 41*a*, element 40*a*, element 40*b*, and key 35 act in conjunction on razor blade 71 to constrain razor blade 71 from moving in all six degrees of freedom while razor blade 71 is locked into razor blade carrier 40. For example, in FIG. 2*d* razor blade 71 is held in razor blade carrier 40. Razor blade 71 is prevented from moving parallel to axis 1 by tab 44 and engaging tab 41*a*. Razor blade 71 is prevented from moving parallel to axis 2 by an edge of key 35 and a bend in element 40*a*. Razor blade 71 is prevented from moving parallel to axis 3 by the opposing sides of the razor blade carrier 40, 40*a* and 40*b*. As seen in FIG. 2*d*, the razor blade restraints also prevent rotation of razor blade 71.

Figure 9C:
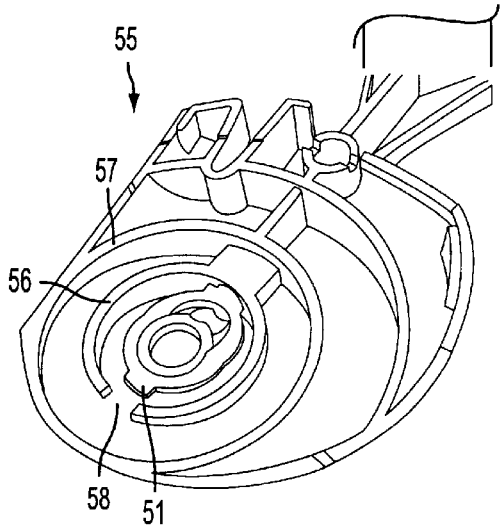
FIG. 9*c* depicts a cut-away view of a razor blade tool with a lock in an unlocked position according to the embodiment of the present invention depicted in FIG. 1.
Figure 9E:
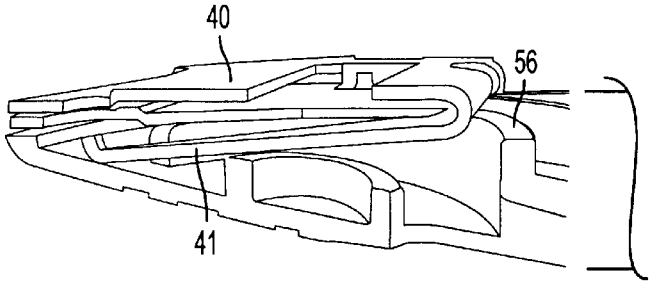
FIG. 9*e* depicts a cut-away view of a razor blade tool showing a razor blade carrier in an unlocked position according to the embodiment of the present invention depicted in FIG. 1.
Figure 9D:
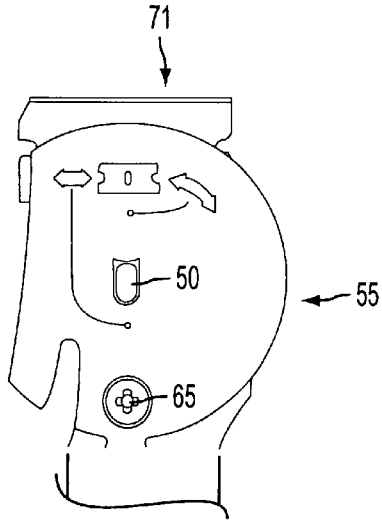
FIG. 9*d* depicts a bottom view of a razor blade tool with a lock in the unlocked position according to the embodiment of the present invention depicted in FIG. 1.

When the lock 50 is pushed to an unlocked position, as depicted in FIGS. 9*c* and 9*d*, tab 51 disengages notch 58, thus creating an opening in cam surface 56. When knob 10 is turned to the scrape position, as depicted in FIG. 17, engaging element 41 moves into notch 58 as depicted in FIG. 9*e*. For example, engaging element 41 is a cantilever beam that acts as a spring because it is biased to move into notch 58 due to elastic deformation. Movement of engaging element 41 into notch 58 allows tab 41*a* to withdraw through center hole 74 in the razor blade 71, and through aperture 41*b* in the razor blade carrier 40. As depicted in FIG. 9*e*, engaging element 41 moves a sufficient distance so that engaging tab 41*a* is clear of the lower surface of element 40*b* of the razor blade carrier 40. This movement of engaging element 41 disengages engaging tab 41*a* from the razor blade 71. With the lock 50 in the unlocked position, depicted in FIGS. 9*c* and 9*d*, and engaging element 41 causing disengagement of tab 41*a* from center hole 74, a user may freely slide razor blade 71 into and out of razor blade carrier 40. In the exemplary embodiment of the present invention, moving the lock 50 to the unlock position allows engaging element 41 to move away from the razor blade carrier 40 when the razor blade 71 is positioned in the scrape position. Thus, a razor blade 71 may be inserted into and removed from the razor blade tool 5 when the razor blade carrier 40 is in the scrape position and the lock 50 is in the unlocked position.

After a new razor blade 71 has been inserted into razor blade carrier 40, and when notch 73 has engaged tab 44 on the razor blade carrier 40, lock 50 is slid into the lock position, i.e., tab 51 now fills notch 58 and becomes part of cam surface 56, which forces engaging element 41 towards the razor blade carrier 40. Movement of lock 50 into the lock position causes engagement tab 41*a* to engage center hole 74 of the new razor blade 71. The new razor blade 71 is now secured in the razor blade carrier 40 as described supra.

Figure 10:
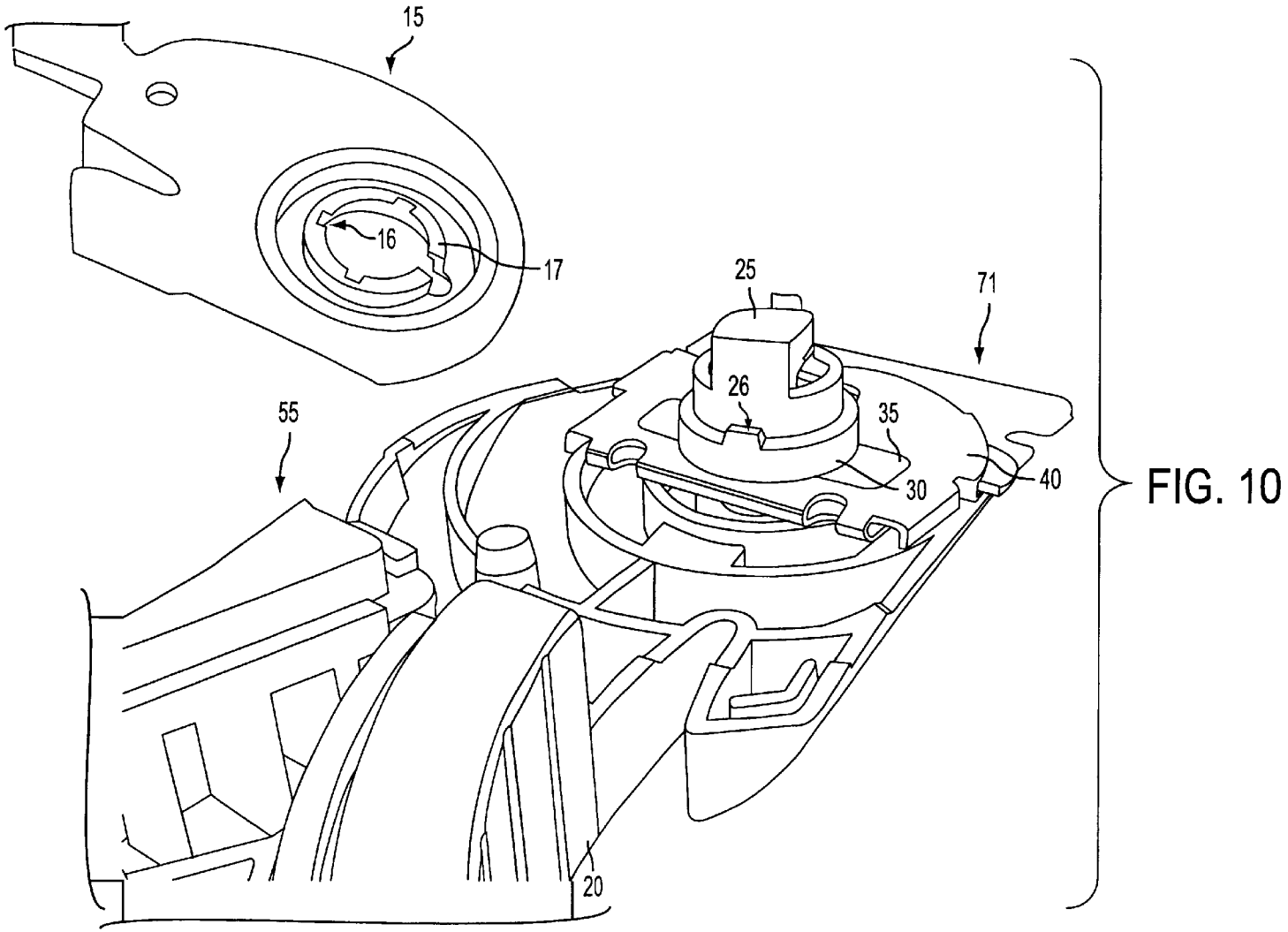
FIG. 10 depicts a cut-away view of a razor blade tool showing positioning elements that are used to maintain a razor blade at various positions according to the embodiment of the present invention in FIG. 1.

Referring to FIG. 10 rotation of razor blade 71 is now described. Spring 30 pushes knob insert 25 away from the razor blade carrier 40. Force exerted by spring 30 causes positioning protrusion 26 of the knob insert 25 to mate with notch 16 when the razor blade 71 is, for example, in one of the positions depicted in any of FIGS. 15 through 18. This first position, i.e., when positioning protrusion 26 is engaged in a notch 16, prevents rotation of the rotation mechanism. Knob 10 is attached to housing portion 15 in a manner that allows knob 10 to be rotated, and that limits the distance knob 10 can move towards and away from razor blade carrier 40. For example, knob 10 is snap fit into ring 11 (FIG. 1). Limiting movement of knob 10 away from razor blade carrier 40 prevents spring 30 from pushing knob insert 25 too far from razor blade carrier 40, thus preventing disassembly of the rotation mechanism.

Figure 11:
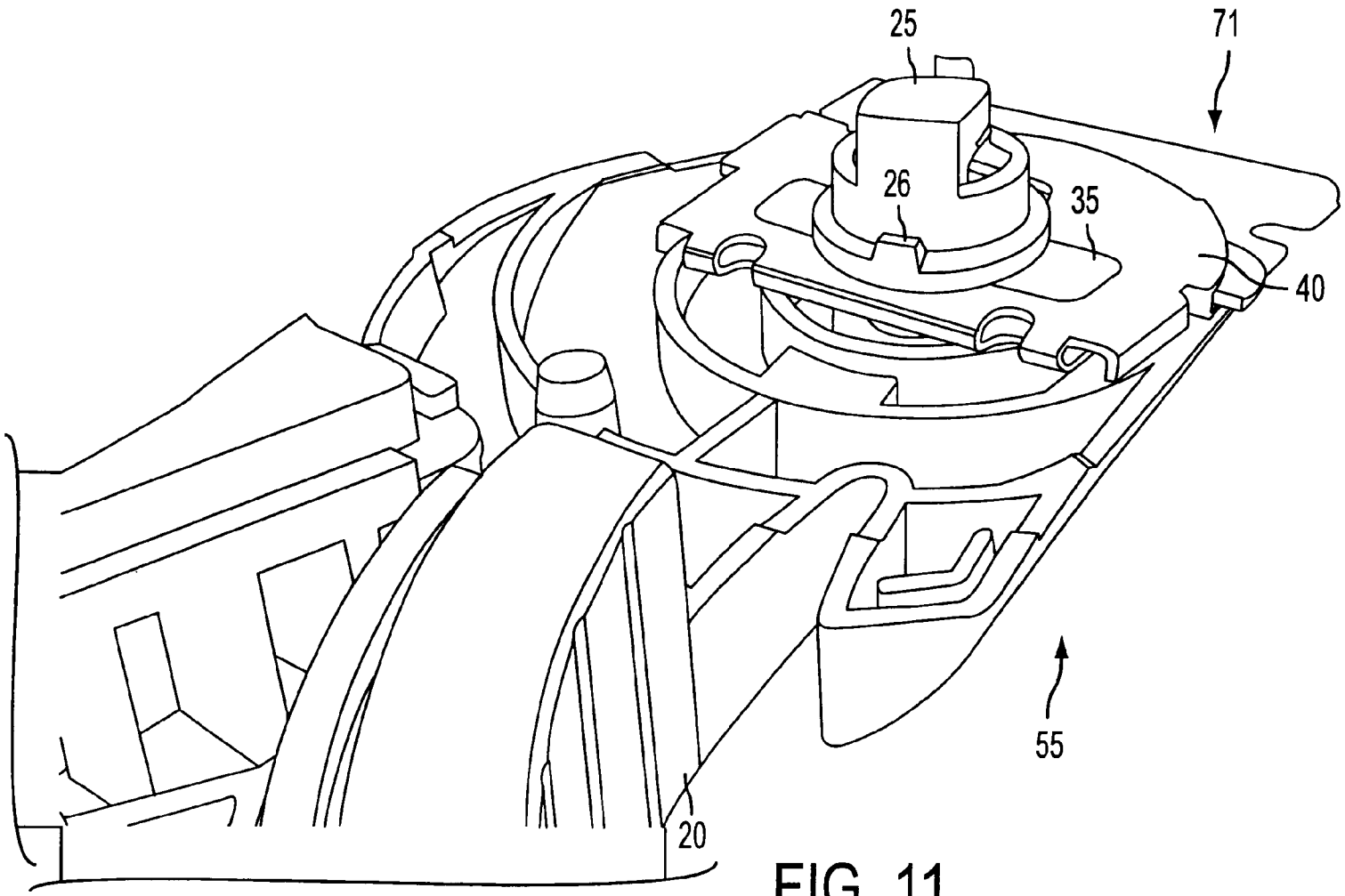
FIG. 11 depicts a cut-away view of a razor blade tool showing rotation of a razor blade according to the embodiment of the present invention depicted in FIG. 1.
Figure 12:
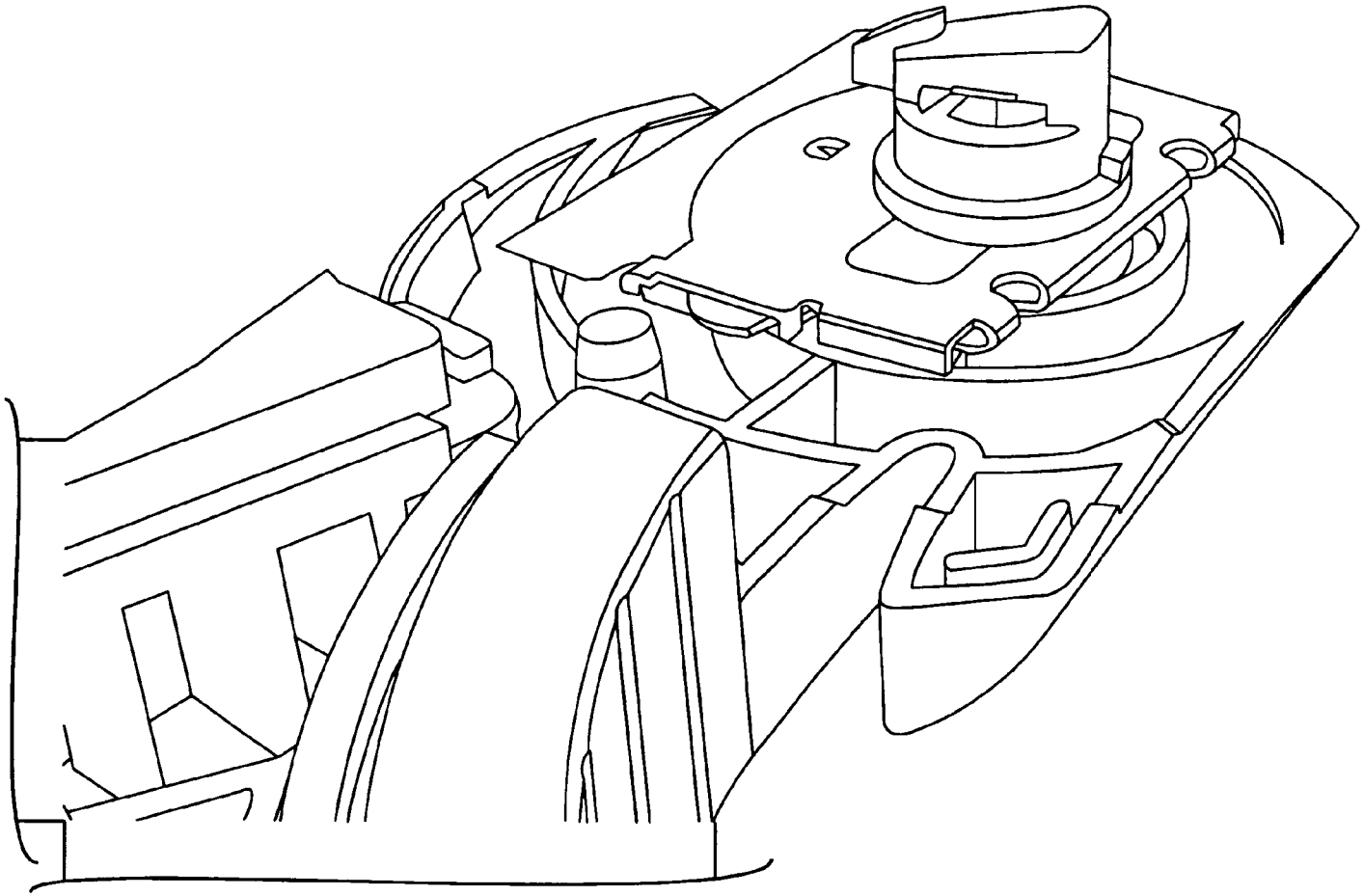
FIG. 12 depicts a cut-away view of a razor blade tool showing a razor blade in a position different from the position depicted in FIG. 11.
Figure 13:
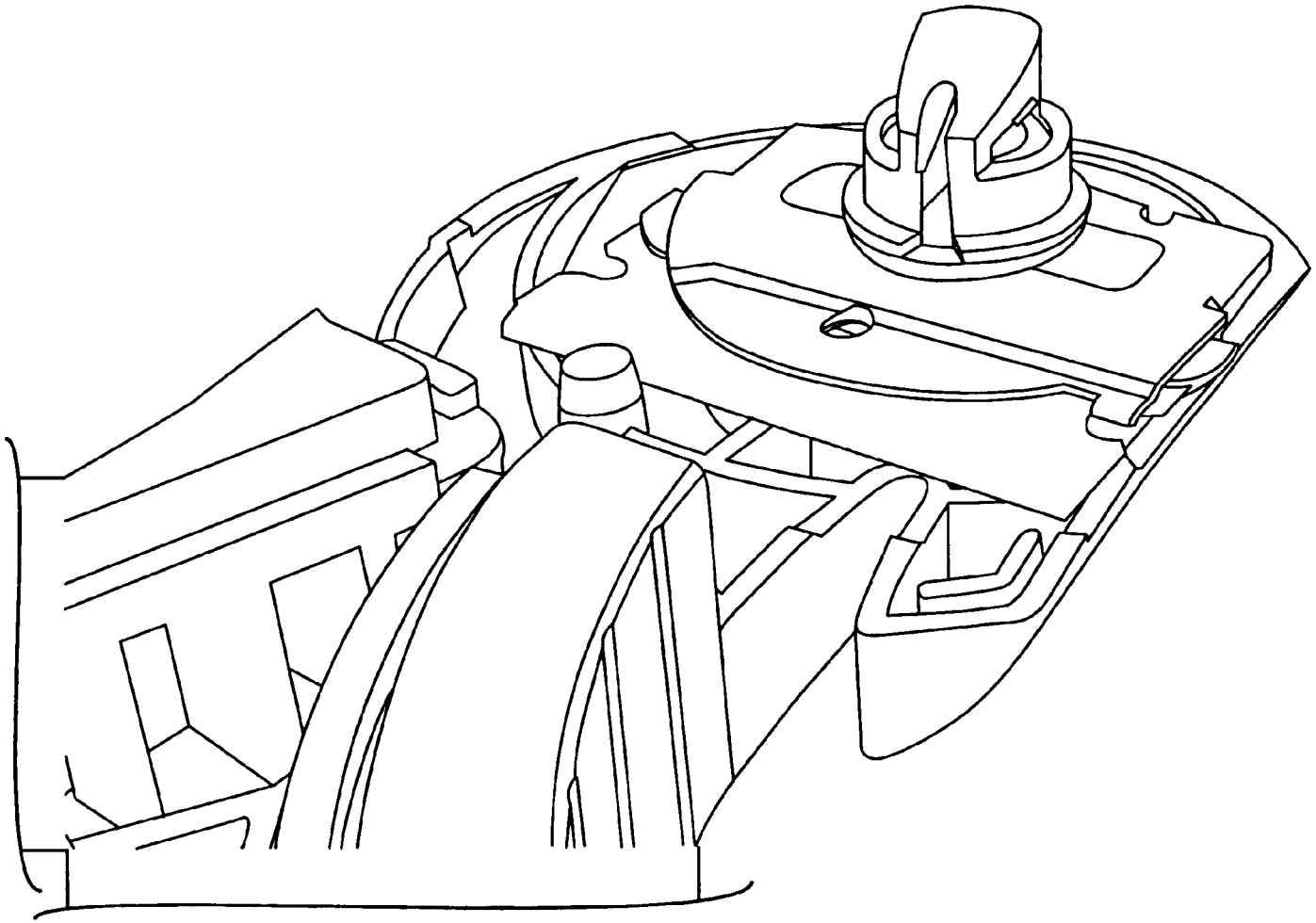
FIG. 13 depicts a cut-away view of a razor blade tool showing a razor blade in a position different from either position depicted in FIG. 11 or in FIG. 12.
Figure 14:
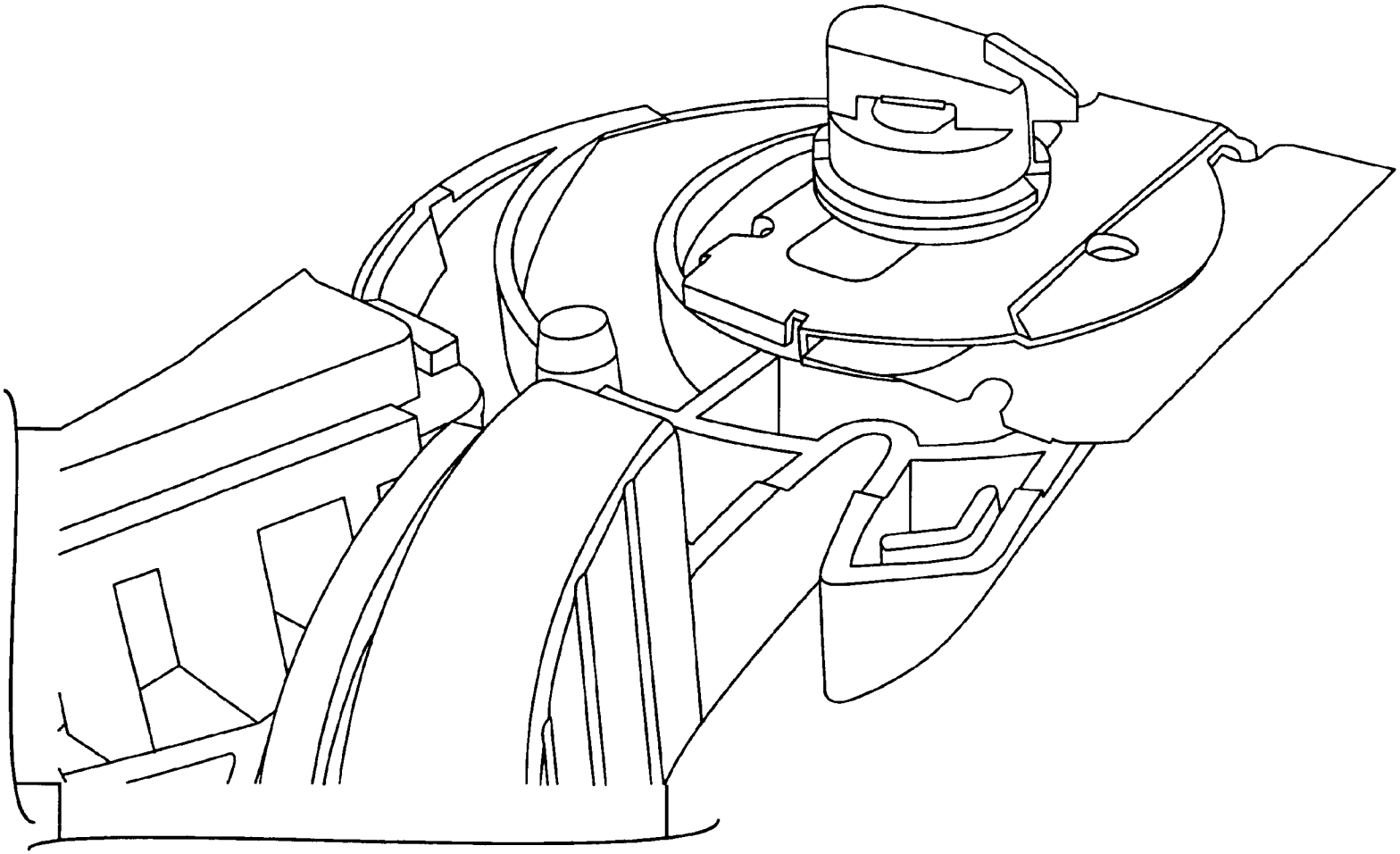
FIG. 14 depicts a cut-away view of a razor blade tool showing a razor blade in a position different from any position depicted in FIG. 11, FIG. 12, or FIG. 13.
Figure 15:
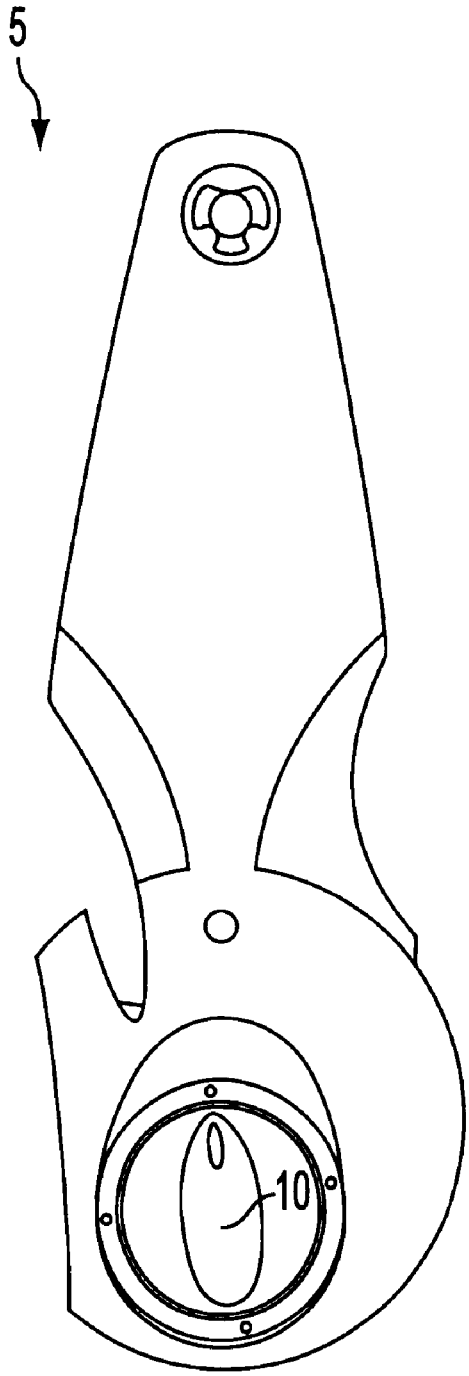
FIG. 15 depicts a top view of a razor blade tool showing a razor blade in the position depicted in FIG. 13.
Figure 16:
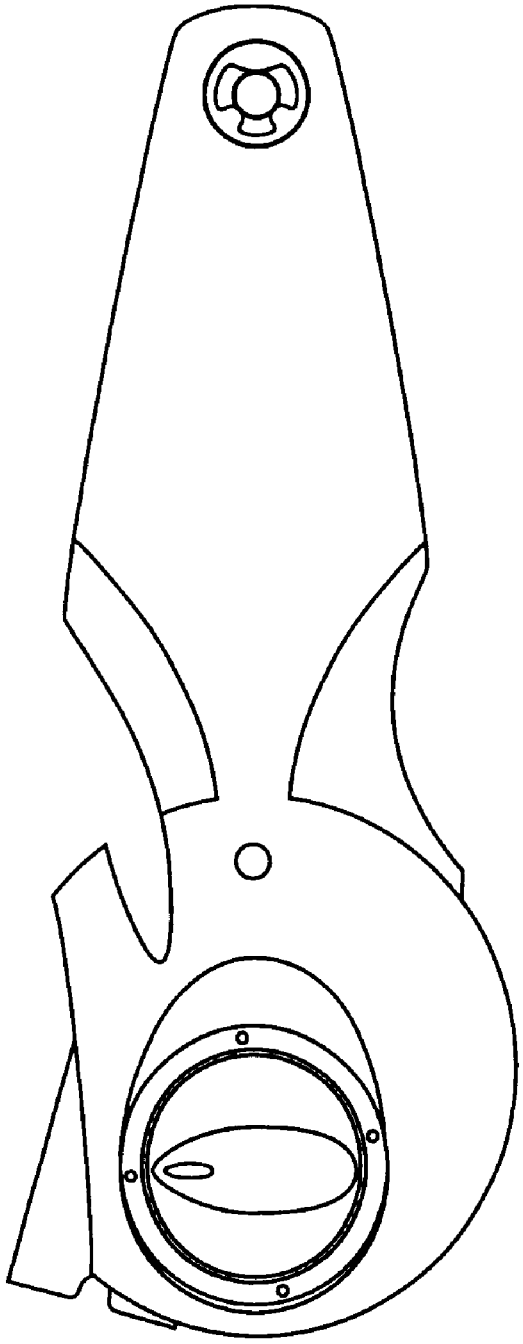
FIG. 16 depicts a top view of a razor blade tool showing the razor blade in the position depicted in FIG. 14.

Engagement of positioning protrusion 26 with notch 16 prevents knob insert 25 from rotating. Because knob insert 25 is non-rotatably connected to key 35, which in turn is non-rotatably connected to razor blade carrier 40, which in turn is non-rotatably connected to razor blade 71, engagement of positioning protrusion 26 with notch 16 prevents razor blade 71 from rotating. Referring to FIG. 11, rotation of razor blade 71 is brought about by pushing down on knob 10. Pushing down on knob 10 overcomes the force exerted by spring 30, and forces positioning protrusion 26 out of notch 16. This pushed-down position, i.e., when spring 30 is further compressed, is the second position of the rotation mechanism. By rotating knob 10 while pushing on knob 10, knob insert 25 is rotated, thus positioning protrusion 26 is rotated away from notch 16 and along the underside of track 17 (FIG. 10). When positioning protrusion 26 is in a position along track 17 so that it is between notches 16, the downward force on knob 10 can be released, and the razor blade 71 may still be rotated. Further rotation of the knob 10 causes the rest of the rotation mechanism comprising knob insert 25, key 35, razor blade carrier 40 and razor blade 71 to rotate until positioning protrusion 26 aligns with another notch 16. When positioning protrusion 26 aligns with a notch 16, the force exerted by spring 30 forces positioning protrusion 26 into the aligned notch 16, thus preventing further rotation of knob 10 and the connected rotating mechanism through to razor blade 71. In like manner, the razor blade can be turned between various positions intended for different uses, i.e., a string cutting position, a knife position, a scraper position, and a case cutter position, as depicted in FIGS. 15 through 18, respectively.

Figure 20:
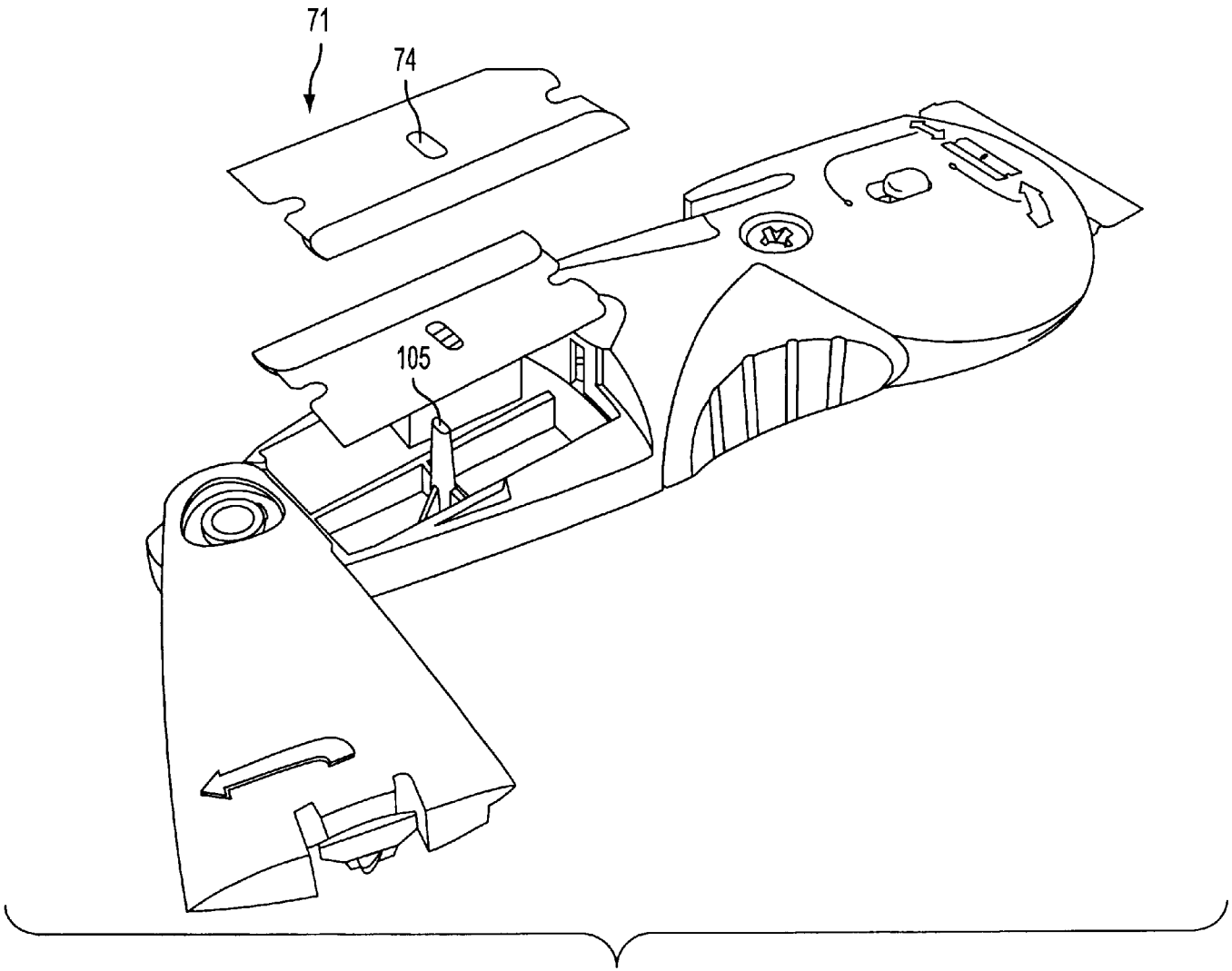
FIG. 20 depicts a bottom view of a razor blade tool showing razor blades inserted into a razor blade storage area according to the embodiment of the present invention depicted in FIG. 1.

Referring now to FIGS. 19–23, the storage of razor blades 70, 71 in storage area 100 is described. Cover 60 is moved to expose storage area 100. In the exemplary embodiment, cover 60 is rotatably connected to housing portion 55. Post 105 is, for example, formed as part of housing member 15 and protrudes into storage area 100. Razor blades 70, 71 are lowered into storage area 100 as depicted in FIG. 20. Post 105 fits through the center aperture 74 of razor blades 70, 71 in order to engage the razor blades 70, 71 and prevent the razor blades 70, 71 from moving within storage area 100 transversely to the axis of post 105. Note that post 105 is positioned so that the sharpened edges of razor blades 70, 71 do not touch or engage the side-walls of storage area 100. Preventing the sharpened edges of the razor blades from contacting the storage area 100 side-walls prevents the sharp razor blades edges from becoming damaged and dull.

Figure 21:
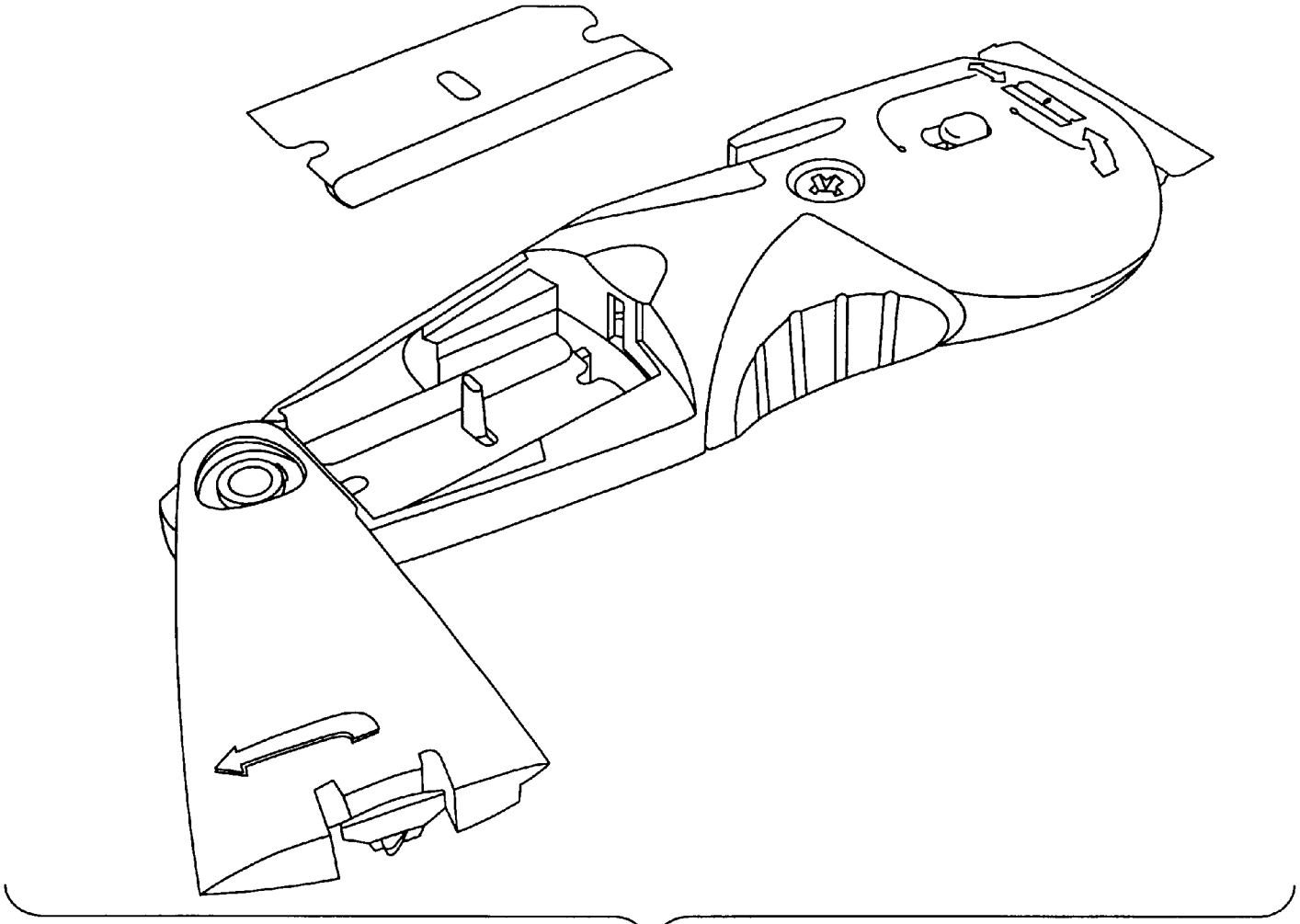
FIG. 21 depicts a bottom view of a razor blade tool showing a razor blade stored in a razor blade storage area according to the embodiment of the present invention depicted in FIG. 1.
Figure 22:
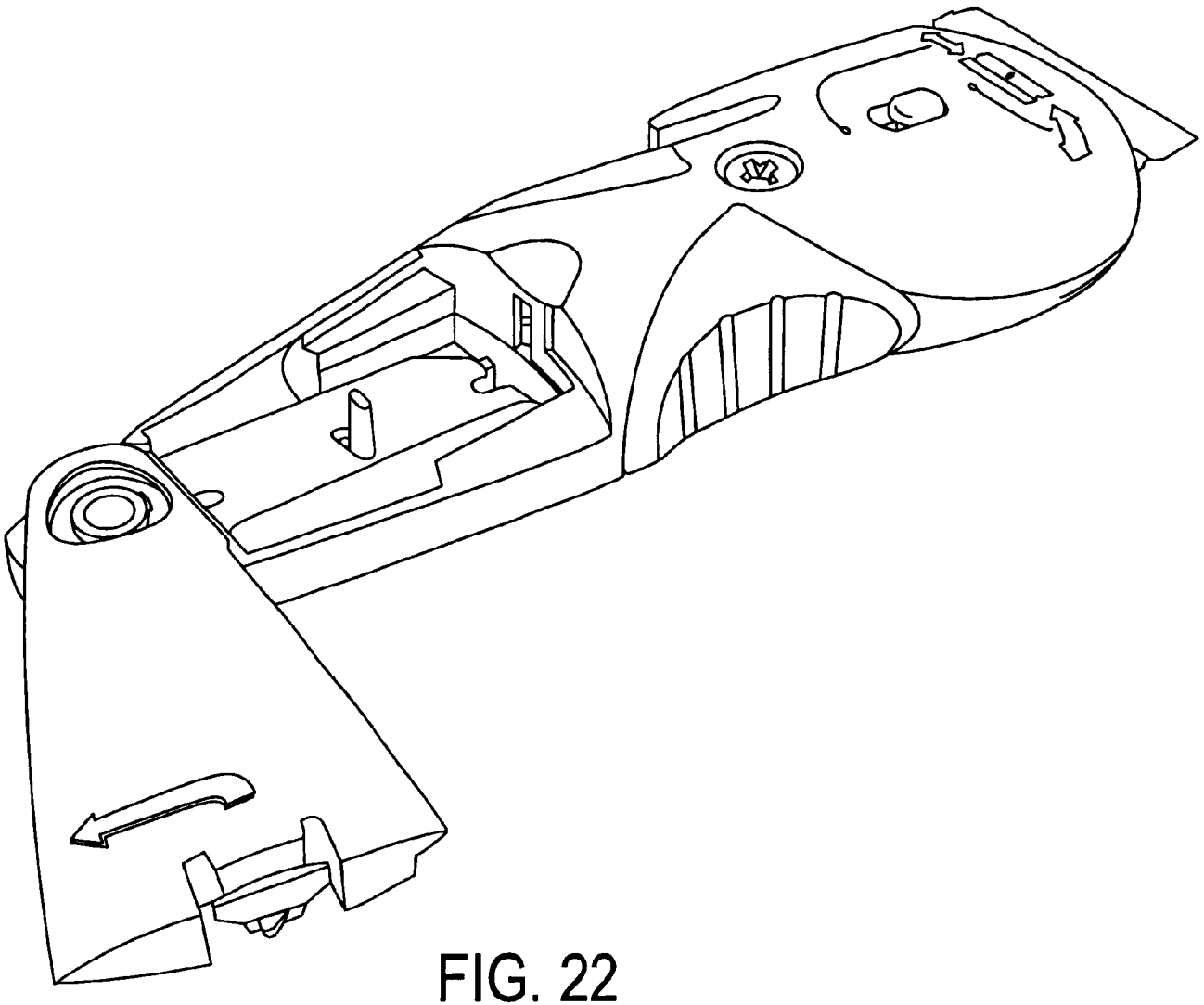
FIG. 22 depicts a bottom view of a razor blade tool showing multiple razor blades stored in a razor blade storage area according to the embodiment of the present invention depicted in FIG. 1.

As depicted in FIGS. 20, 21 and 22, multiple razor blades 70, 71 may be stored in the storage area 100. As depicted in FIG. 23*a*, the cover may be retained non-rotatably with relation to housing portion 55 by an integral spring latch, which engages an opening in the handle when in the closed position.

Figure 23B:
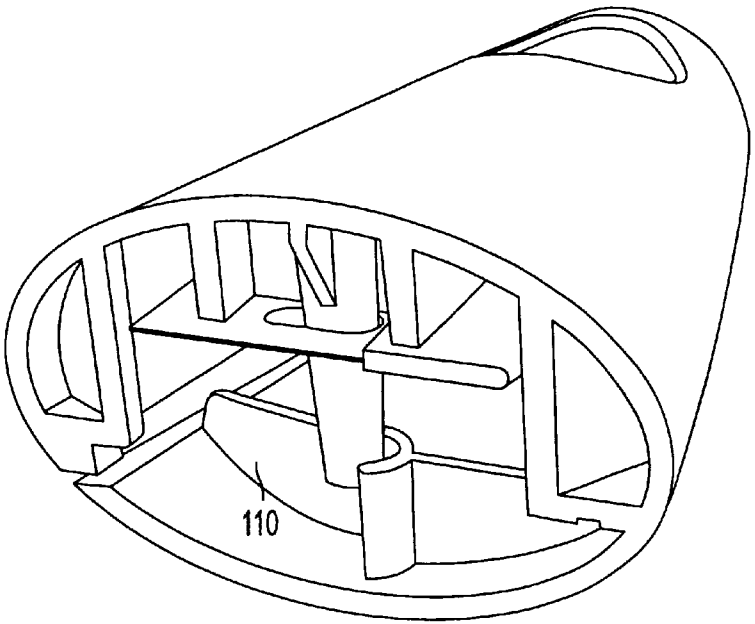
FIG. 23*b* depicts a cut-away view of the handle of a razor blade tool showing a storage area for razor blades according to the embodiment of the present invention depicted in FIG. 1.
Figure 23A:
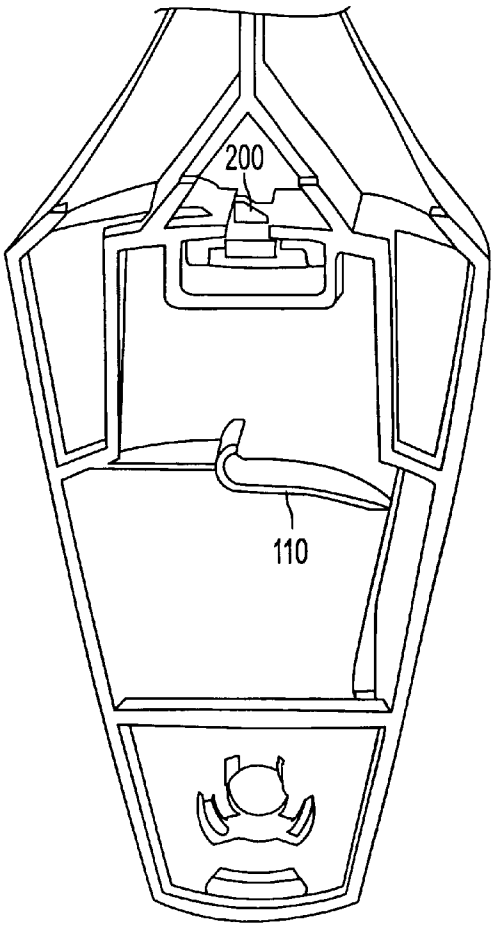
FIG. 23*a* depicts a bottom view of a cover according to the embodiment of the present invention depicted in FIG. 1.

As depicted in FIG. 23, handle portions 15 and 55 of the exemplary embodiment form an arcuate cavity. Post 105 extends from handle portion 15 into the cavity formed between handles 15 and 60, which comprises storage area 100. Because of the arcuate construction of the handle portions 15 and 55, post 105 extends above the height of the side-walls of storage area 100. When cover 60 is rotated into the closed position, a cooperating rib 110, engages post 105. Engagement of the cooperating rib 110 with post 105 prevents razor blades 70, 71 from becoming disengaged from post 105. This ensures that razor blades 70, 71 cannot move axially off of post 105 to a point where they disengage post 105 and are free to move about storage area 100. The positive retention of razor blades 70, 71 within storage area

100 by post 105 and cooperating rib 110 prevents razor blades from becoming lose and protruding between cracks or openings between the housing portions 15 and 55. Thus, a user cannot be cut by a loose razor blade protruding from storage area 100.

In the previous description, numerous specific details are set forth, such as specific materials, structures, materials, processes, etc. in order to provide a better understanding of the present invention. However, the present invention can be practiced without resorting to the details specifically set forth. In other instances, well-known processing structures have not been described in detail in order not to unnecessarily obscure the present invention.

Only the preferred embodiment of the invention and but a few examples of its versatility are shown and described in the present disclosure. It is to be understood that the invention is capable of use in various other combinations and environments, and is capable of changes or modifications within the scope of the inventive concept as expressed herein.

What is claimed is:

1. A razor blade device comprising:

a handle portion;

a razor blade housing connected to the handle portion;

a razor blade carrier for holding a razor blade rotatably mounted within the razor blade housing such that the razor blade carrier is rotatable within the razor blade housing to a plurality of positions, wherein the razor blade housing covers substantially the entire razor blade carrier;

a razor blade storage area in the handle portion configured to store at least one razor blade such that a sharpened edge of a stored razor blade does not contact side-walls of the razor blade storage area; and a cover movably connected to the handle portion to provide access to the razor blade storage area.

2. The razor blade device according to claim 1, wherein:

the razor blade housing is configured to expose a different portion of a sharp edge of a razor blade outside of the razor blade housing for each of the plurality of positions to which the razor blade carrier is rotatable.

3. The razor blade device according to claim 1, further comprising:

a post within the razor blade storage area that is configured to pass through a center hole of at least one stored razor blade.

4. The razor blade device according to claim 3, wherein:

the post is further configured to engage the cover when the cover is in a closed position.

5. A razor blade device comprising:

a handle portion;

a razor blade housing connected to the handle portion;

a razor blade carrier for holding a razor blade rotatably mounted within the razor blade housing such that the razor blade carrier is rotatable to a plurality of positions within the razor blade housing;

a razor blade storage area in the handle portion configured to store at least one razor blade such that a sharpened edge of a stored razor blade does not contact side-walls of the razor blade storage area;

a cover movably connected to the handle portion to provide access to the razor blade storage area;

a post within the razor blade storage area that is configured to pass through a center hole of at least one stored razor blade, wherein the post is configured to engage the cover when the cover is in a closed position;

arcuate handle portions forming a top an bottom surface of the razor blade storage area; wherein the post is higher than the side-walls of the razor blade storage area; and the cover is rotatably connected to the handle portion.

6. The razor blade device according to claim 1, further comprising:

a lock mechanism configured to retain a razor blade in the razor blade carrier when in a first position, and to allow a razor blade to exit the razor blade carrier when in a second position.

7. A razor blade device comprising:

a handle portion;

a razor blade housing connected to the handle portion;

a razor blade carrier for holding a razor blade rotatably mounted within the razor blade housing such that the razor blade carrier is rotatable to a plurality of positions within the razor blade housing;

a lock mechanism configured to retain a razor blade in the razor blade carrier when in a first position, and to allow a razor blade to exit the razor blade carrier when in a second position;

a rotation mechanism within the razor blade housing for rotating the razor blade carrier, comprising:

a key that non-rotatably engages the razor blade carrier;

a spring that engages the key;

an insert that engages the spring, non-rotatably engages the key, and rotatably engages the razor blade housing; and a knob that non-rotatably engages the insert and is accessible outside of the razor blade housing.

8. A razor blade device comprising a handle portion;

a razor blade housing connected to the handle portion;

a razor blade carrier for holding a razor blade rotatably mounted within the razor blade housing such that the razor blade carrier is rotatable to a plurality of positions within the razor blade housing;

a lock mechanism configured to retain a razor blade in the razor blade carrier when in a first position, and to allow a razor blade to exit the razor blade carrier when in a second position, wherein the lock mechanism comprises:

a razor blade engaging tab attached to the razor blade carrier; and a lock actuator moveably attached to the razor blade housing that is moveable to a first position where the lock actuator causes the razor blade engaging tab to engage a razor blade, and to a second position where the lock actuator allows the razor blade engaging tab to disengage from a razor blade.

9. The razor blade device according to claim 1, wherein the razor blade carrier further comprises:

a stop attached to the razor blade carrier configured to engage a notch in a razor blade.

10. A razor blade device comprising:

a handle portion;

a razor blade retaining portion comprising:

a razor blade housing connected to the handle portion; and a razor blade carrier for holding a razor blade rotatably mounted within the razor blade housing such that the razor blade carrier is rotatable within the razor blade housing to a plurality of positions, wherein the razor blade housing covers substantially the entire razor blade carrier; and a razor blade storage area for storing razor blades without sharp edges of any razor blades contacting surfaces of the razor blade storage area, comprising:

an upper surface comprising a moveable cover that provides access to the storage area;

a lower surface;

side-wall surfaces; and a post attached to the lower surface that is at least as high as the side-walls, is configured to pass through a center aperture in stored razor blades, and engages the cover when the cover is in a closed position.

11. The razor blade device according to claim 10, wherein:

the upper surface is arcuate;

the lower surface is arcuate; and the cover is arcuate.

12. A razor blade device comprising:

a handle portion;

a razor blade housing;

a razor blade carrier rotatably mounted within the razor blade housing configured to retain a razor blade;

a rotation mechanism non-rotatably connected to the razor blade carrier, rotatably connected to the razor blade housing, and accessible outside of the razor blade housing; and a stop on the razor blade carrier configured to engage a notch in a razor blade.

13. The razor blade device according to claim 12, wherein the rotation mechanism engages the razor blade housing in a first position to prevent rotation of the razor blade carrier, and disengages the razor blade housing in a second position to allow rotation of the razor blade carrier.

14. The razor blade device according to claim 12, further comprising:

a lock mechanism configured to retain a razor blade in the razor blade carrier.

15. The razor blade device according to claim 12, further comprising:

a first razor blade position;

a second razor blade position;

a third razor blade position; and a fourth razor blade position; wherein the razor blade device is configured to substantially cover a sharp edge of a razor blade when the razor blade carrier is in the first razor blade position;

the razor blade device is configured to substantially expose a sharp edge of a razor blade when the razor blade carrier is in the second razor blade position;

the razor blade device is configured to completely expose a sharp edge of a razor blade when the razor blade carrier is in the third razor blade position; and the razor blade device is configured to expose only a corner of a sharp edge of a razor blade when the razor blade carrier is in the fourth razor blade position.

16. The razor blade device according to claim 15, further comprising:

a slot in the razor blade housing configured to provide access to a portion of a sharp edge of a razor blade when the razor blade carrier is in the first razor blade position.

17. A razor blade device comprising:

a first housing portion;

a second housing portion connected to the first housing portion to define a hollow housing; and a razor blade carrier for holding a razor blade rotatably mounted within one end of the housing such that the razor blade carrier is rotatable to a plurality of positions within the housing; wherein the first housing portion is statically retained with respect to the second housing portion while the razor blade carrier is allowed to rotate.

18. The razor blade device according to claim 17, further comprising:

a razor blade storage area within the housing configured to store a razor blade without a sharp edge of a razor blade contacting sidewalls of the storage area; and a cover moveably attached to he first housing portion configured to provide access to the razor blade storage area.

* * * * *